US007375689B2

(12) United States Patent
Chen et al.

(10) Patent No.: US 7,375,689 B2
(45) Date of Patent: May 20, 2008

(54) MULTI-BAND ANTENNA OF COMPACT SIZE

(75) Inventors: Yun-Ta Chen, Tao-Yuan (TW); Chien-Pang Chou, Tao-Yuan (TW); Chang-Hao Hsieh, Tao-Yuan (TW)

(73) Assignee: High Tech Computer Corp., Taoyuan, Taoyuan County (TW)

( * ) Notice: Subject to any disclaimer, the term of this patent is extended or adjusted under 35 U.S.C. 154(b) by 0 days.

(21) Appl. No.: 11/560,812

(22) Filed: Nov. 16, 2006

(65) Prior Publication Data

US 2007/0200777 A1 Aug. 30, 2007

(30) Foreign Application Priority Data

Feb. 27, 2006 (TW) ..... 95106679 A

(51) Int. Cl.
*H01Q 1/24* (2006.01)

(52) U.S. Cl. ..... 343/702; 343/702; 343/803; 343/764; 343/765

(58) Field of Classification Search ..... 343/803, 343/764, 765

See application file for complete search history.

(56) References Cited

U.S. PATENT DOCUMENTS

| | | | | |
|---|---|---|---|---|
| 4,044,303 | A * | 8/1977 | Reindel | 324/95 |
| 6,317,099 | B1 * | 11/2001 | Zimmerman et al. | 343/803 |
| 6,496,382 | B1 * | 12/2002 | Ferguson et al. | 361/767 |
| 6,697,025 | B2 * | 2/2004 | Koyanagi et al. | 343/741 |
| 6,820,314 | B2 * | 11/2004 | Ferguson et al. | 29/25.42 |
| 6,930,640 | B2 | 8/2005 | Chung et al. | |
| 7,170,448 | B2 * | 1/2007 | Jecko et al. | 343/700 MS |
| 2004/0084296 | A1 * | 5/2004 | Hori et al. | 204/157.15 |
| 2005/0184917 | A1 * | 8/2005 | Cuthbert | 343/742 |
| 2006/0097930 | A1 * | 5/2006 | Rosenberg et al. | 343/702 |
| 2006/0181466 | A1 | 8/2006 | Krupa | |
| 2007/0035447 | A1 * | 2/2007 | Chen et al. | 343/700 MS |

FOREIGN PATENT DOCUMENTS

| | | |
|---|---|---|
| DE | 100 03 082 A1 | 7/2001 |
| TW | 200419843 | 10/2004 |
| WO | WO 98/44587 A1 | 10/1998 |
| WO | WO 00/65684 A2 | 11/2000 |
| WO | WO 02/29926 A1 | 4/2002 |

* cited by examiner

*Primary Examiner*—Trinh V Dinh
(74) *Attorney, Agent, or Firm*—Winston Hsu

(57) ABSTRACT

A multi-band antenna of compact size includes a conductor of uniform cross-section folded to form the antenna with a connection portion, a low-frequency first radiation portion, and a high-frequency second radiation portion. The connection portion has a feeding point for signal feeding. The first and second radiation portions connect to two ends of the connection portion. The first radiation portion is folded along two different planes to form three main sections. The second radiation portion is folded along a plane to form two sections. A terminal section of the first radiation portion and a terminal section of the second radiation portion are parallel, such that radiation of these two sections is coupled to enhance radiation characteristics of the antenna. Also, the folded structure helps to achieve compact size of the antenna.

17 Claims, 26 Drawing Sheets

MULTI-BAND ANTENNA OF COMPACT SIZE

BACKGROUND OF THE INVENTION

1. Field of the Invention

The present invention provides a multi-band antenna of compact size, in particular a monopole antenna of a compact size with a three-dimensional bending structure that uses a characteristic of coupling effectively between different frequency bands to improve the antenna's efficiency.

2. Description of the Prior Art

In a modern world of information, various wireless communication networks have become one of the most important channels for exchanging sounds, text, numerical results, data, and video for many people. An antenna is required to receive information carried by wireless electromagnetic waves in a wireless communications network. Therefore the development of antennas has also become one of key issues for vendors in the technology field. In order to have users implement and access information from different wireless networks in ease, an antenna with better design should be able to cover different bands of each wireless communications network with only one antenna. Besides, the size of the antenna should be as small as possible to be implemented in compact portable wireless devices (such as cellphones, Personal Digital Assistants i.e. PDAs).

In the prior art, Planar Inverted-F Antennas (PIFAs) are the most popular for wireless communication network transceiving services. Please refer to FIG. 1. FIG. 1 is a diagram of an antenna 10 that is a typical PIFA. A PIFA generally uses a planar radiation portion and a planar base to induce an electromagnetic wave oscillation. In addition, an antenna as shown in the R.O.C. patent publications number 20041 9843 (corresponding to U.S. Pat. No. 6,930,640) is also a type of PIFA. However, when using this type of antenna as a multi-band antenna, a planar radiation portion of the antenna requires a large planar area, and a distance between the radiation plane and a base plane of the antenna d0 (as in FIG. 1 ) is related to a frequency/bandwidth of the antenna that cannot be adjusted as desired. Thus, the antenna of the prior art cannot be structurally reduced in size and is unable to meet the needs of compactness and multi-band reception.

SUMMARY OF THE INVENTION

A multi-band antenna according to the present invention includes a coupling portion for feeding-in or feeding-out signals. A first radiation portion is coupled to one end of the coupling portion. The first radiation portion is bended at one or more bending points to form a plurality of sections with the plurality of sections distributed on two planes that are not parallel to each other. A second radiation portion is coupled to another end of the coupling portion. The second radiation portion includes at least one section and the at least one section of the second radiation portion is paralleled to at least one section of the first radiation portion in order to have radiation characteristics of the two paralleled sections coupled to each other for increasing a bandwidth of the multi-band antenna.

These and other objectives of the present invention will no doubt become obvious to those of ordinary skill in the art after reading the following detailed description of the preferred embodiment that is illustrated in the various figures and drawings.

DETAILED DESCRIPTION

Please refer to FIGS. 2-5. FIGS. 2-5 are diagrams with different viewing angles of an embodiment 20 of an antenna of the present invention. The antenna of the present invention 20 can be a monopole antenna, with a coupling portion CP, a low frequency radiation portion L, and a high frequency radiation portion H to have the antenna of the present invention 20 functioning in multi-band and supporting different requirements from each frequency band of wireless communications. As shown in FIGS. 2-5, the antenna 20 can be formed with bended conductors having uniform cross sections (for example, a copper wire having circular cross sections). The low frequency radiation portion L and the high frequency radiation portion H are extensions of different (opposite) ends of the coupling portion CP and hence form a three-dimensional structure. The coupling portion CP feeds-in or feeds-out signals with a signal feeding point S, the low frequency radiation portion L and the high frequency radiation portion H are for inducing radiation characteristics of low frequency and high frequency bands, so the antenna 20 of the present invention can cater to both low and high frequency bands in wireless communicational needs. In the embodiment shown in FIGS. 2-5, the low frequency radiation portion L extends longer and can be bended at a plurality of bending points to form a plurality of sections along two non-parallel planes in a three-dimensional space, whereas the high frequency radiation portion H is shorter and can be bended at a single point to form two sections.

Figure 6:
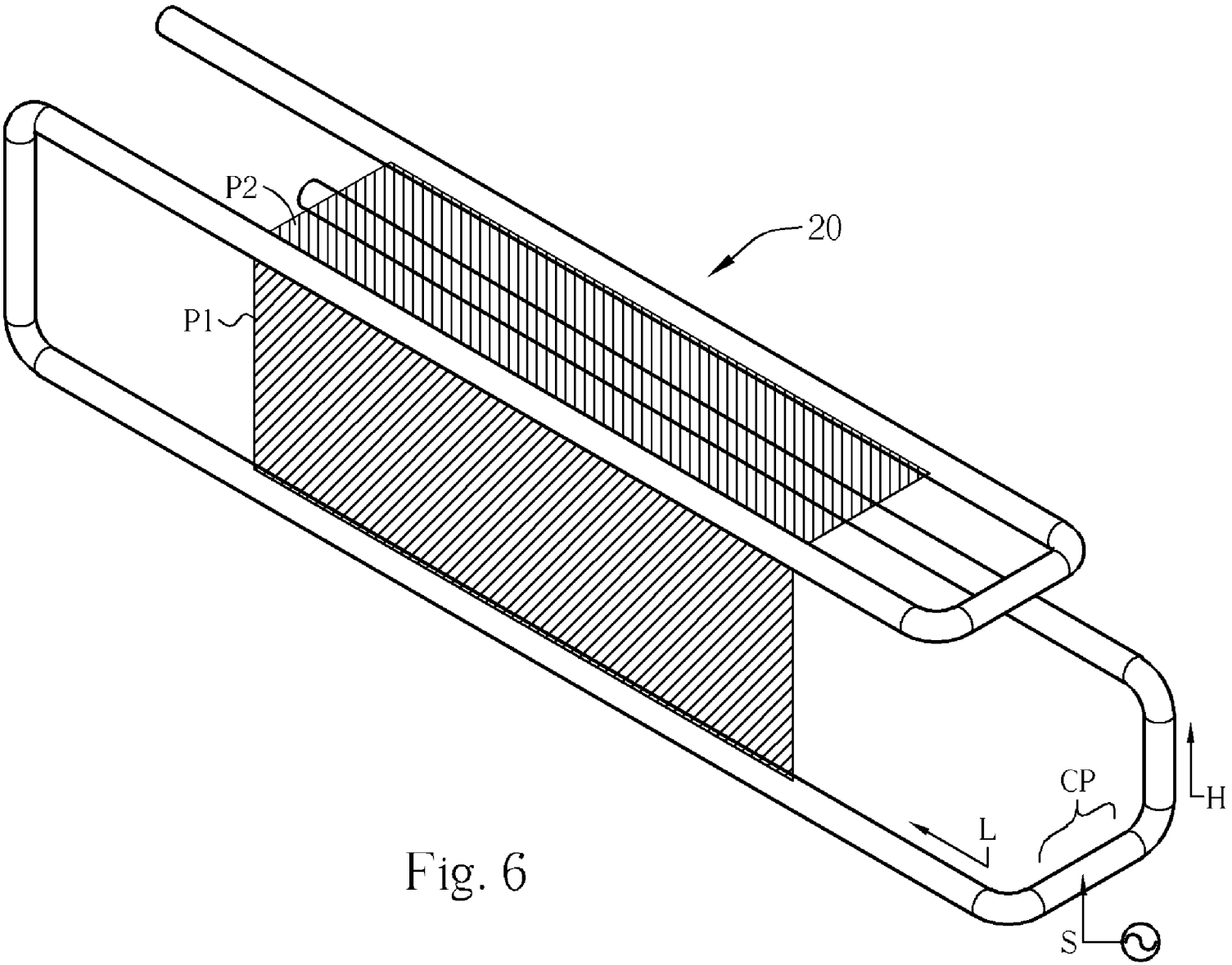
FIGS. 6-9 present different portions of the antenna in FIG. 2.
Figure 7:
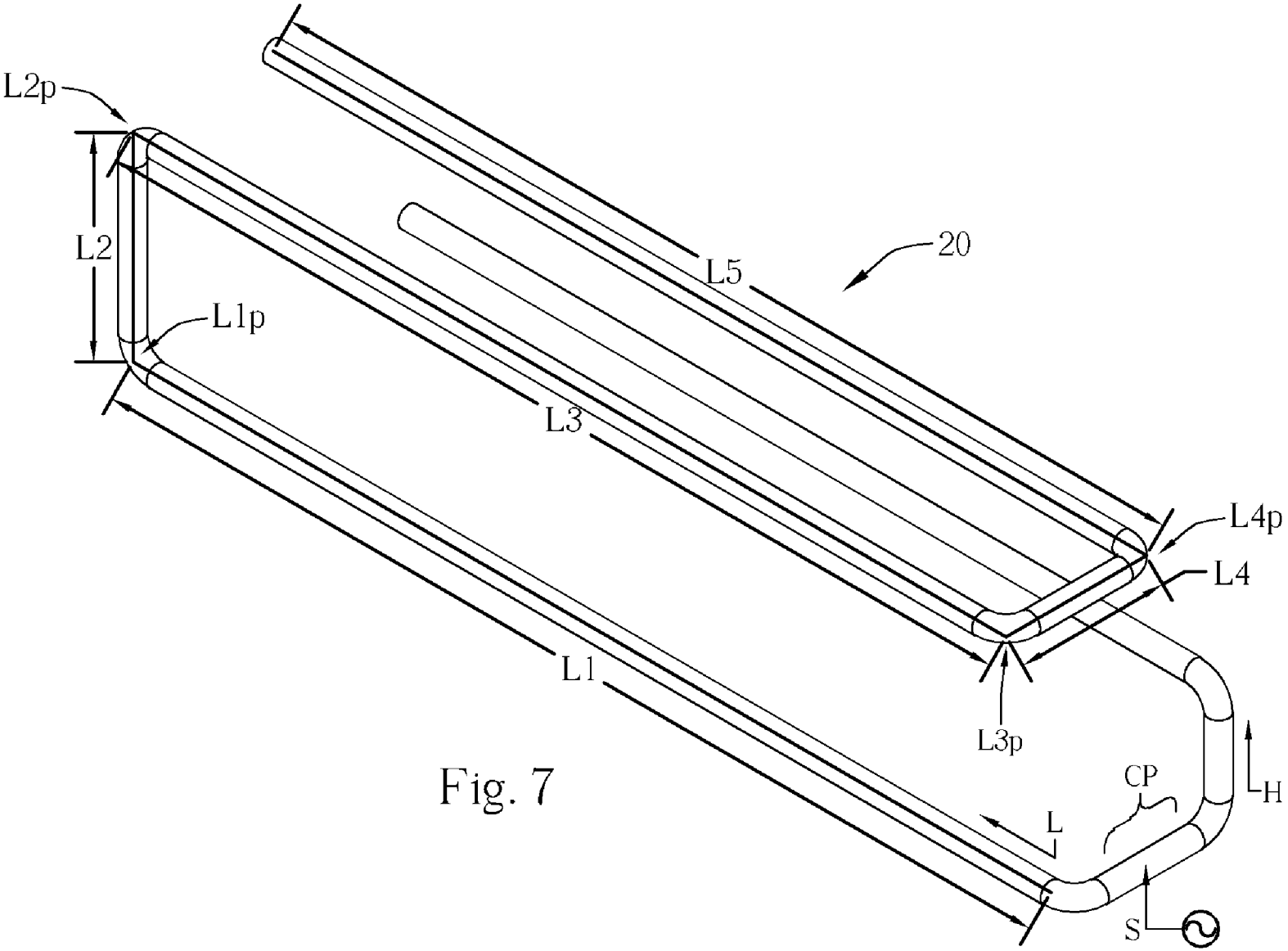

Along with the embodiment shown in FIGS. 2-5, please refer to FIGS. 6-9. FIGS. 6-9 more clearly show and explain structures of each part of the antenna 20. As seen in FIG. 6 and FIG. 7, the low frequency radiation portion L of the antenna 20 bends along two non-parallel planes P1 and P2 (FIG. 6), and bends to form sections L1 to L5 (FIG. 7) at bending points L1*p* to L4*p*. The sections are three main (longer) sections L1, L3, and L5 and two shorter sections L2 and L4. Of the low radiation portions L1 to L5, the furthermost portion is L5, so L5 can be seen as a low radiation frequency portion of L. Furthermore, in FIGS. 8 and 9, the high frequency radiation portion H of the antenna 20 bends along a plane P3 (FIG. 9) at a bending point H1*p* to form two sections H1, and H2 (FIG. 8) on a same plane. Within each section of the high frequency radiation portion H, the section that extends the furthest from the coupling portion CP is the section H2, so that the section H2 is recognized as a terminal section of the high frequency radiation portion H. Based on the structure of the antenna of the present invention in FIG. 9, it is known that other than a terminal section L5 being able to be on the same plane as each section of the high frequency radiation portion H (H1, H2), and at least one section of the other sections of the low frequency radiation portion L (L1 to L4) is on a different plane from the high frequency radiation portion H. Due to the structure of the antenna, a size of the present invention is effectively reduced and meets the requirements of compact portable communications devices.

Figure 9:
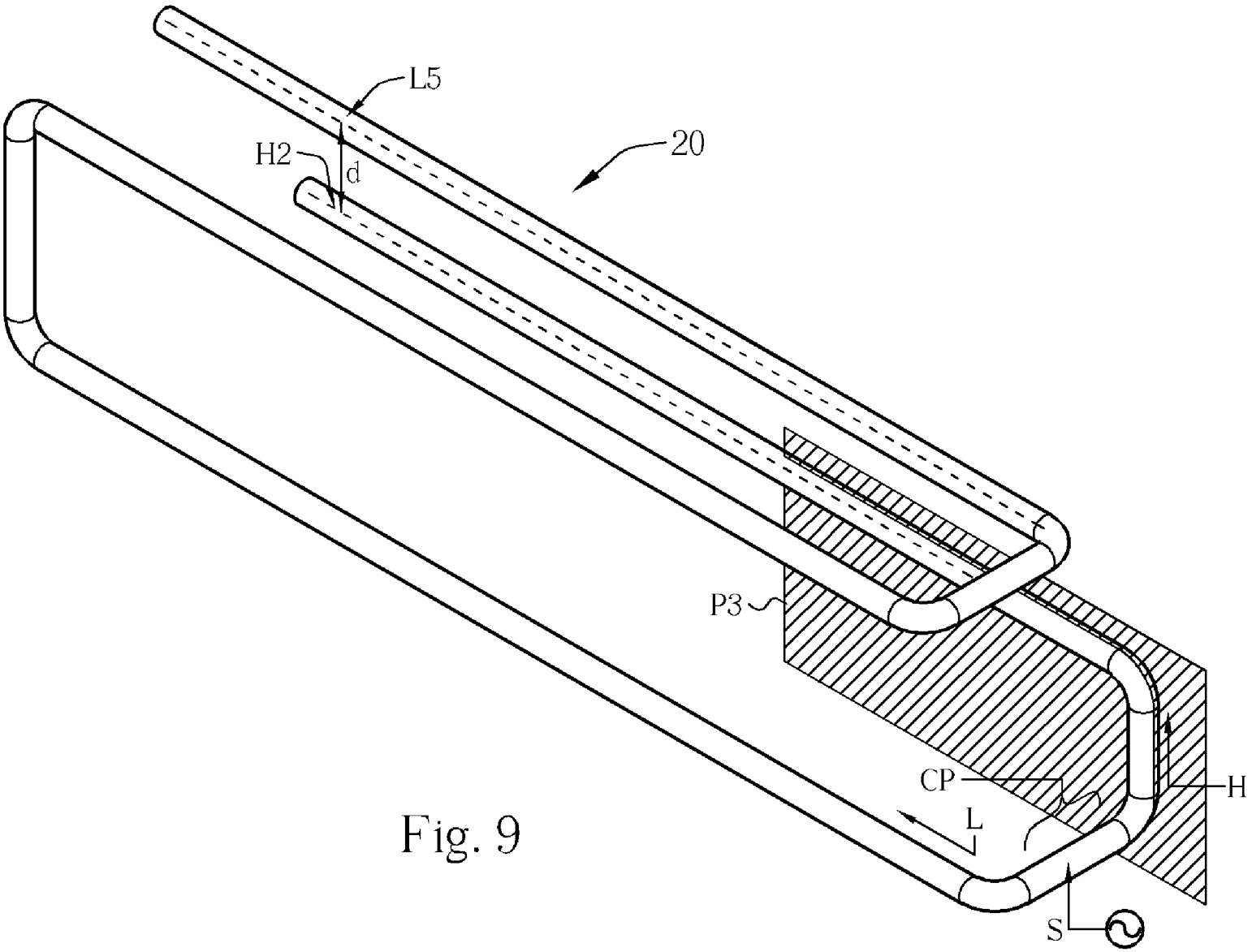

As for the structure of the antenna 20 shown in FIG. 9, the terminal section L5 of the low frequency radiation portion L is parallel to the terminal section H2 of the high frequency radiation portion H, and the distance between the two terminal sections is d. To compare, distances between the terminal section H2 and other sections (like L1, L3) of the low frequency radiation portion L are larger than the distance d. Because the terminal sections of low and high frequency radiation portions are close and parallel to each other, the present invention is able to improve overall characteristics with couplings between the low and high frequency radiation portions.

Figure 10:
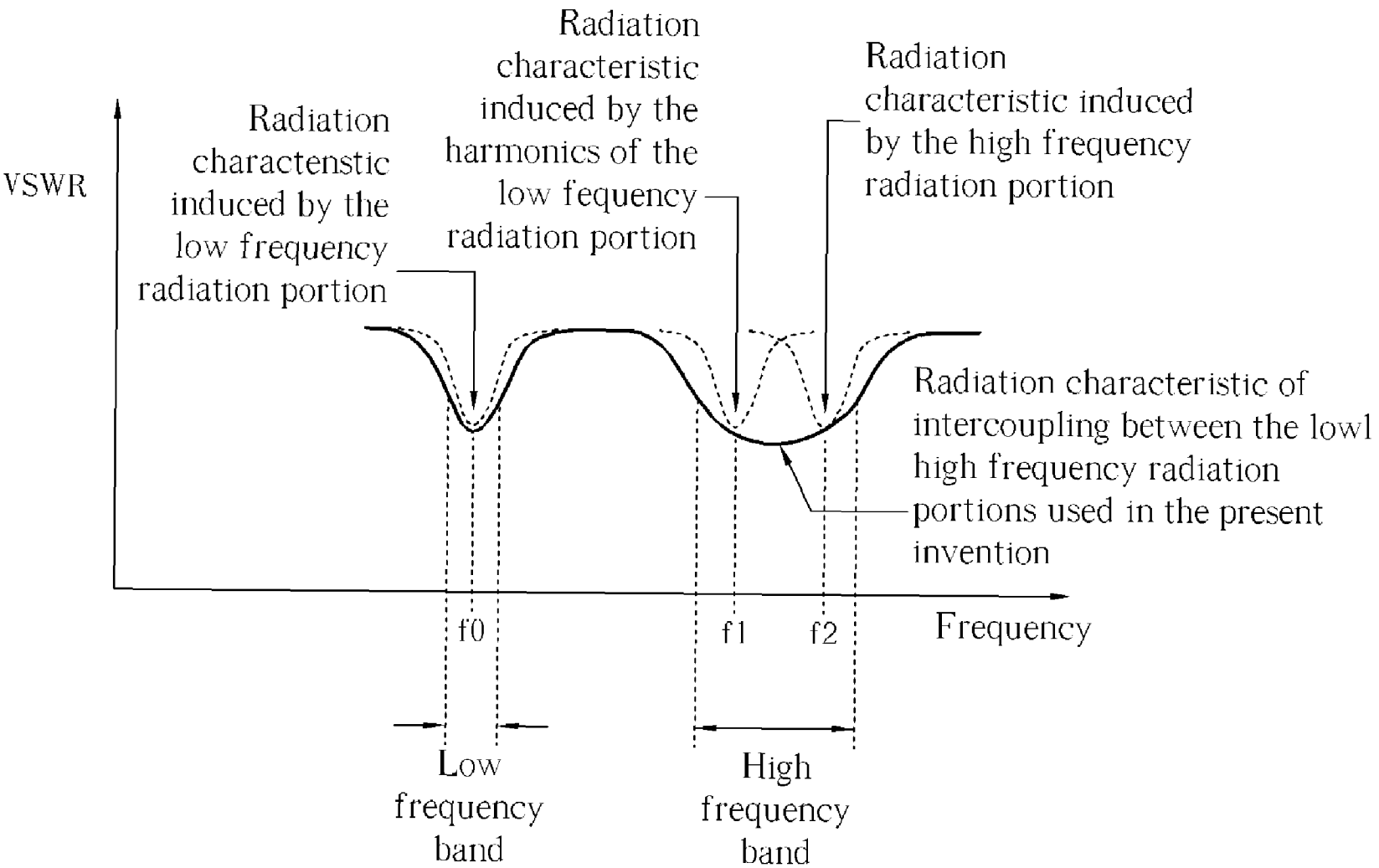
FIG. 10 presents frequency characteristics formed by an intercoupling effect of high/low frequency radiation portions of the antenna of the present invention.

Please refer to FIG. 10, which illustrates the theory of couplings between the low/high frequency radiation portions in a frequency spectrum according to the characteristics of the present invention. The horizontal axis represents frequency and the vertical axis represents frequency spectrum characteristics. For instance, the vertical axis can be VSWR (Voltage Standing Wave Ratio). For people who are familiar with the technique, a local minimum of the VSWR in a spectrum can represent a usable bandwidth of an antenna, so the VSWR is usually used to show a radiation characteristic of an antenna (especially in a frequency spectrum).

FIG. 10 presents that if only the low frequency radiation portion is considered, the low frequency radiation portion of the antenna with longer length induces a low frequency local minimum (shown in FIG. 10 with a broken line) at a low frequency band (i.e. around frequency f0). Similarly, taking only the high frequency radiation portion into account, with a shorter high frequency radiation portion, the antenna induces a high frequency local minimum (also represented with a broken line) around a frequency f2 at a high frequency band. In general, a bandwidth of the high frequency band can barely simultaneously support different working bands required by different high frequency communications (2G/3G applications). However, as discussed earlier, the antenna of the present invention is especially designed to have a stronger coupling between the low and the high frequency radiation portions, so overall characteristics of the antenna are improved with the intercoupling. The intercoupling causes two effects. First, the intercoupling promotes coupling of harmonics of the low frequency radiation portion and hence induces a local minimum at a harmonic frequency. Secondly, as presented in FIG. 10, a second harmonic of the low frequency radiation portion can induce another local minimum at a frequency f1 (meaning that the frequency f1 is about twice of the frequency f0), and this helps for expanding usable bandwidth of the high frequency band.

Besides, the intercoupling between the low/high frequency radiation portions can also produce equivalent intercoupled/autocoupled inductances and capacitances between each section. The inductance and capacitance lower a Q factor of the antenna accordingly to increase a bandwidth of frequency spectrum of the antenna. From FIG. 2 to FIG. 9, sections L1, L3, and L5 of the antenna 20 intercouple with the section H2 to form an intercoupled capacitance. Each section produces equivalent inductances from intercoupling/autocoupling (e.g., at bending points), and these inductive, capacitive effects can reduce the Q factor of the antenna 20. As the Q factor gets larger, the bandwidth gets smaller. Hence the decrease in Q factor reflects on the spectrum as the increase in bandwidth. As curves shown in FIG. 10, since the present invention increases bandwidth with intercoupling effects, the local minimums at frequencies f1 and f2 can expand while the Q factor decreases and combine with each other to form a usable band of high frequency and to fulfill requirements of different wireless communication networks.

In theory, the intercoupling between the high and low frequency radiation portions is actually interference, but the present invention takes advantages of this character and utilizes the intercoupling to expand the usable bandwidth so that the interference has turned to be an advantage of the antenna's performance. The present invention fine-tunes overall characteristics of the antenna of the present invention (e.g., a center frequency of the usable band and it bandwidth etc.) by changing a distance between the two terminal sections of the low/high frequency radiation portion (presented as a distance d in FIG. 9) to change a degree of intercoupling between the two terminal sections and therefore achieves the fine-tuning process. For example, to increase the distance d (FIG. 9), a length of a section H1 can be reduced appropriately to reduce the intercoupling between the two terminal sections.

Figure 1:
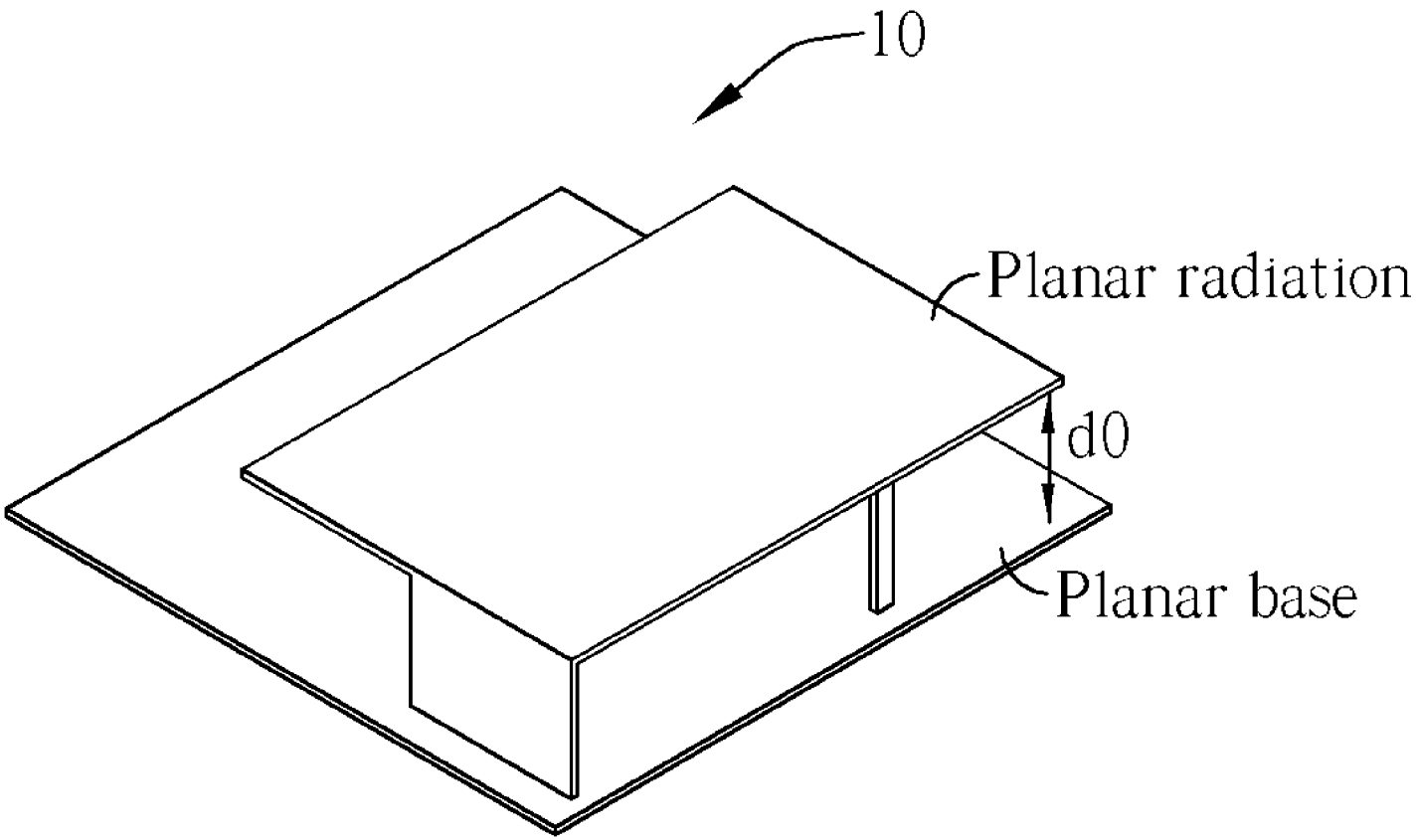
Fig. 1 Prior art
FIG. 1 is a diagram of an antenna of the prior art.
Figure 8:
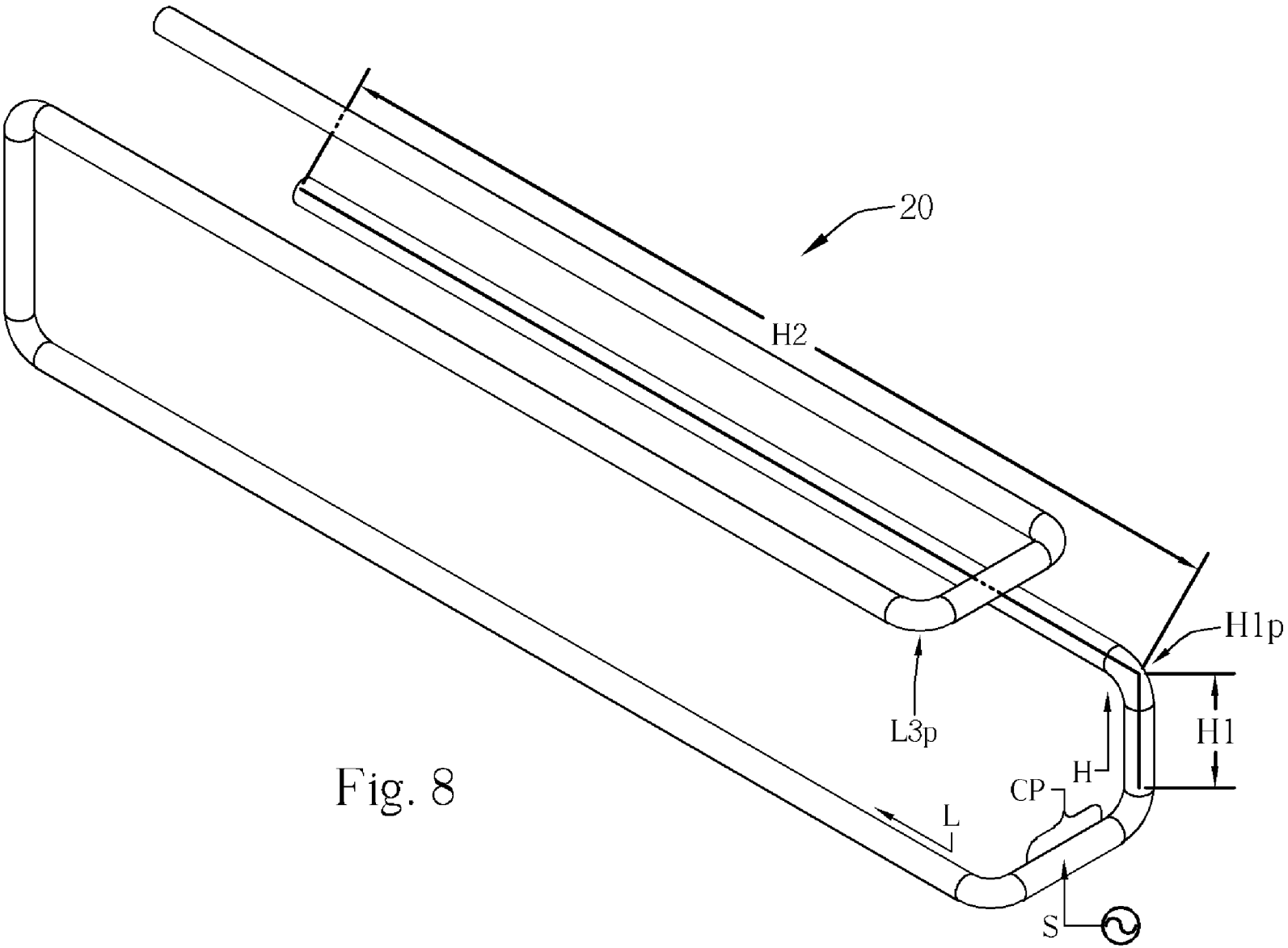
Figure 11:
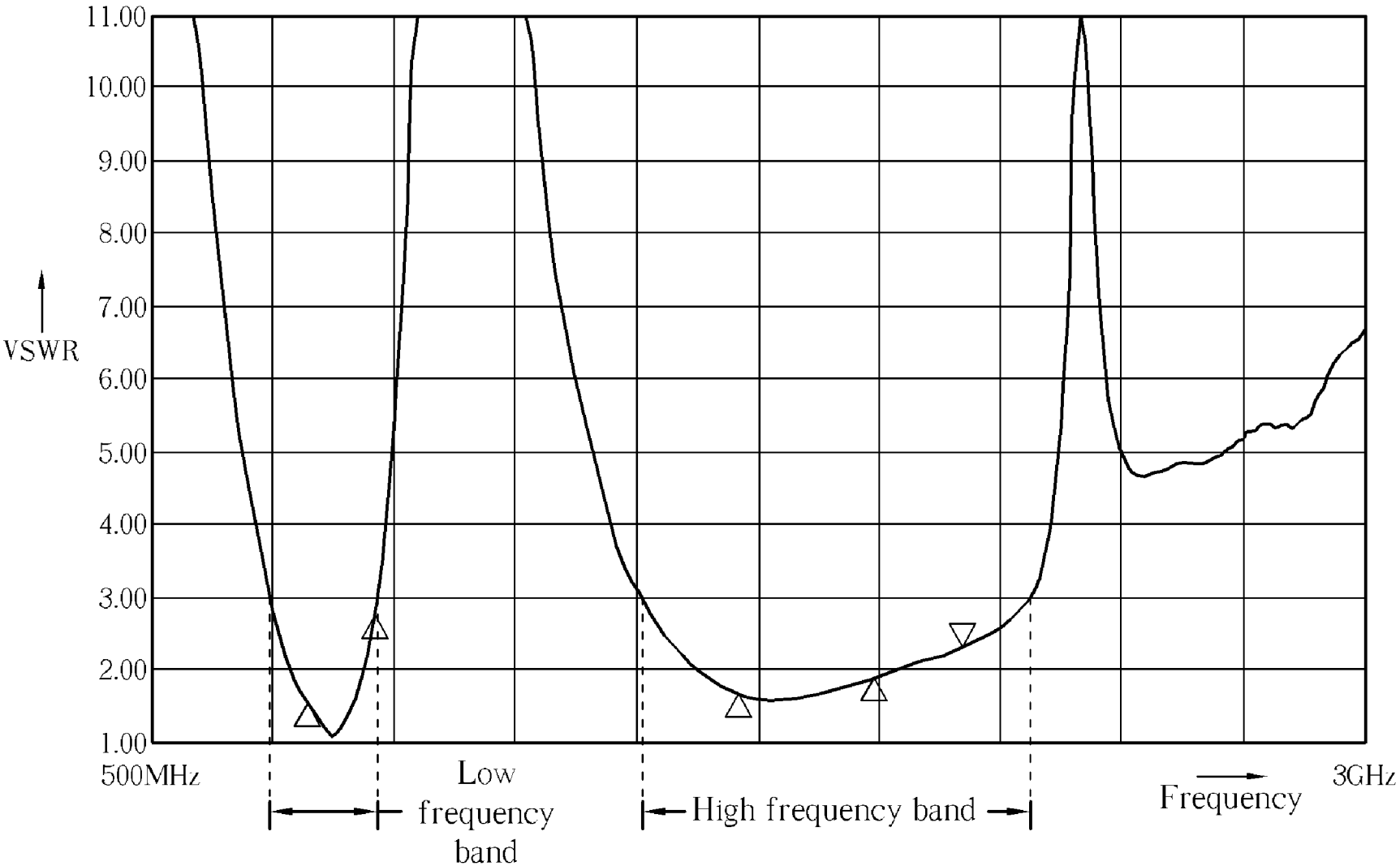
FIG. 11 is a diagram of a voltage standing wave ratio (VSWR) of the antenna of the present invention in practice.

In application, the present invention uses sections having lengths around 3 cm (or shorter) to support 5 different bands, including Global System for Mobile communication (GSM) 850/900, GSM 1800/1900, UMTS (Universal Mobile Telecommunications System) 2100. Supporting low frequencies of the GSM850/900 communications networks conventionally requires a low frequency radiation conductor around 9 cm long. Due to the three-dimensional bended structure of the low frequency radiation portion of the present invention, the conductor only needs to be around 3 cm (or shorter) to support GSM850/900 requirements. On the other hand, the present invention uses a wide bandwidth expanded by the intercoupling between the low/high frequency radiation portions and hence fully supports high frequency bands of GSM1800/1900 and UMTS 2100. For a more realistic description, please refer to FIG. 11. With an antenna structure design shown in FIG. 2, the present invention realistically practices a frequency spectrum characteristic as shown in FIG. 8 where the horizontal axis represents frequency and the vertical axis represents VSWR. From FIG. 1, the antenna supports GSM850/900 in low frequency band while covering GSM1800/1900 and UMTS 2100 in the high frequency wideband. With only one antenna, 5 different bands from different wireless communications requirements are met, therefore a multi-band antenna is achieved.

As the present invention is small in size and supports high frequency bands, it can be applied on various portable communications devices, like cellphone, Personal Digital Assistants (PDAs), or laptop computers etc.

Figure 12:
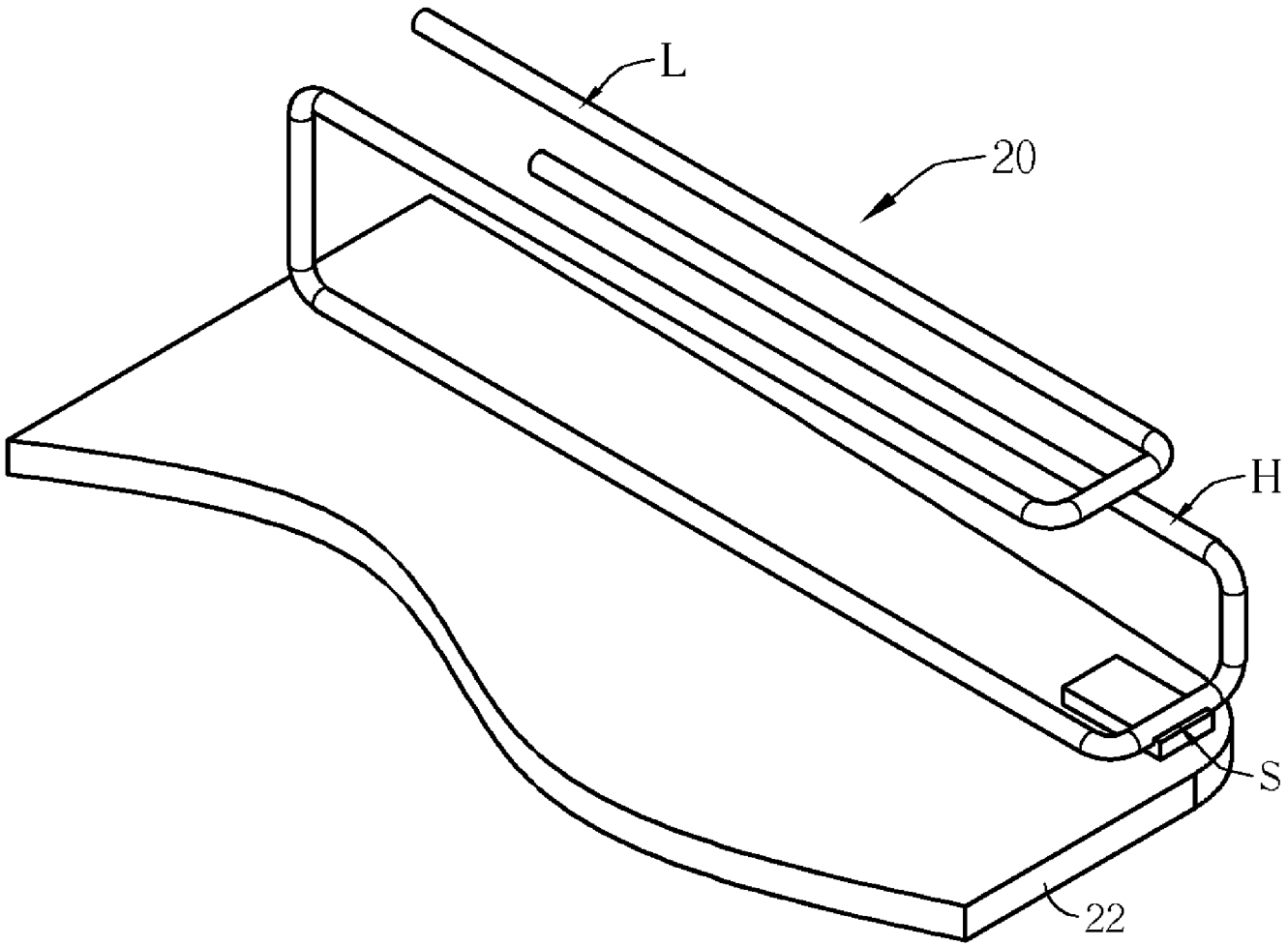
FIG. 12 is a diagram of the antenna in FIG. 2 installed on a circuit board.
Figure 13:
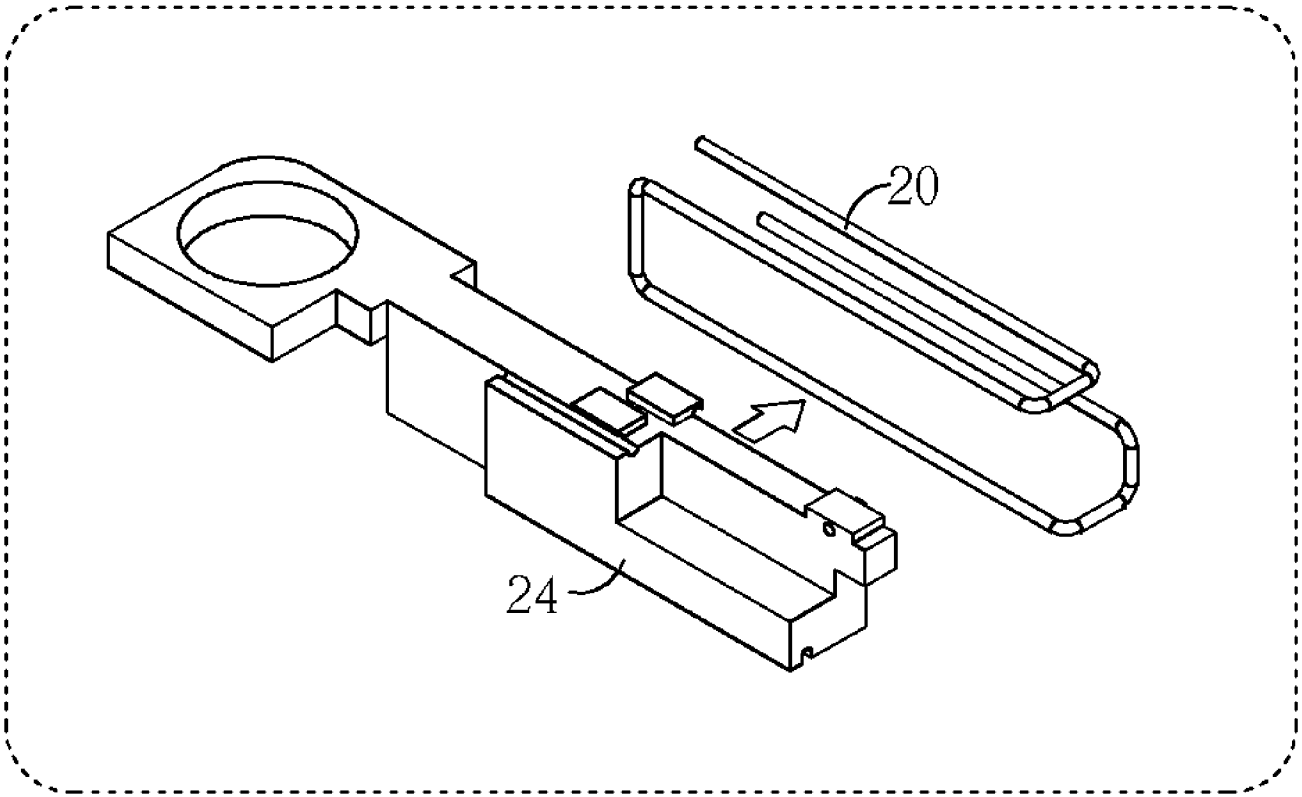
FIGS. 13-16 are diagrams of the antenna in FIG. 2 installed on a fixture.
Figure 14:
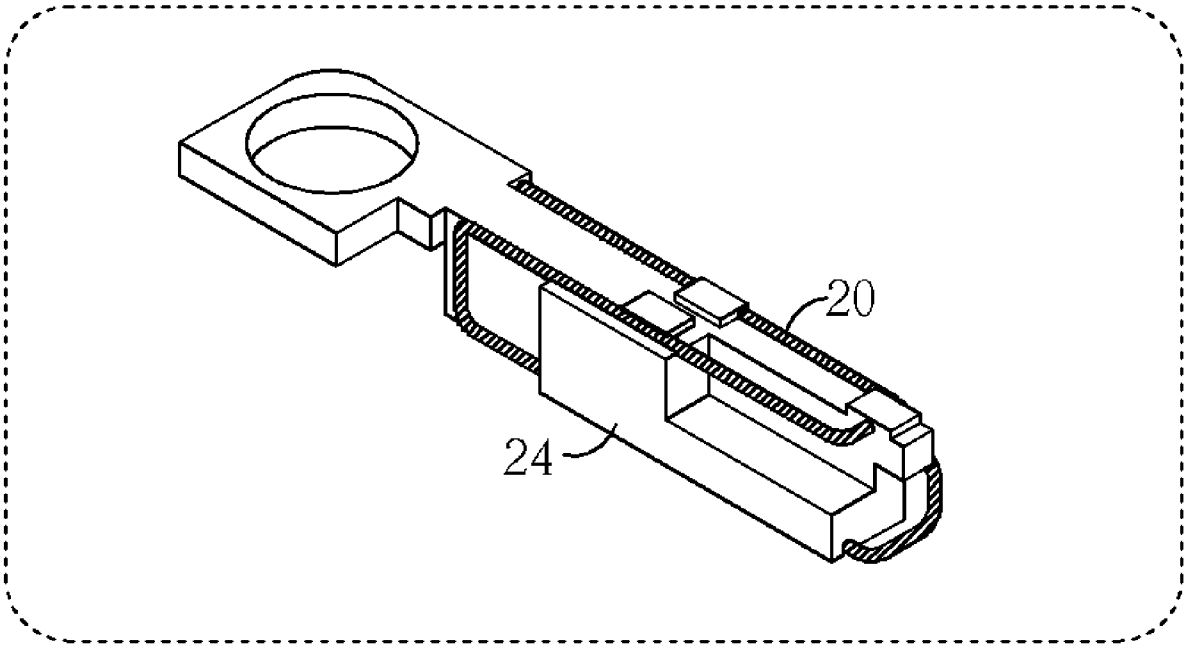
Figure 15:
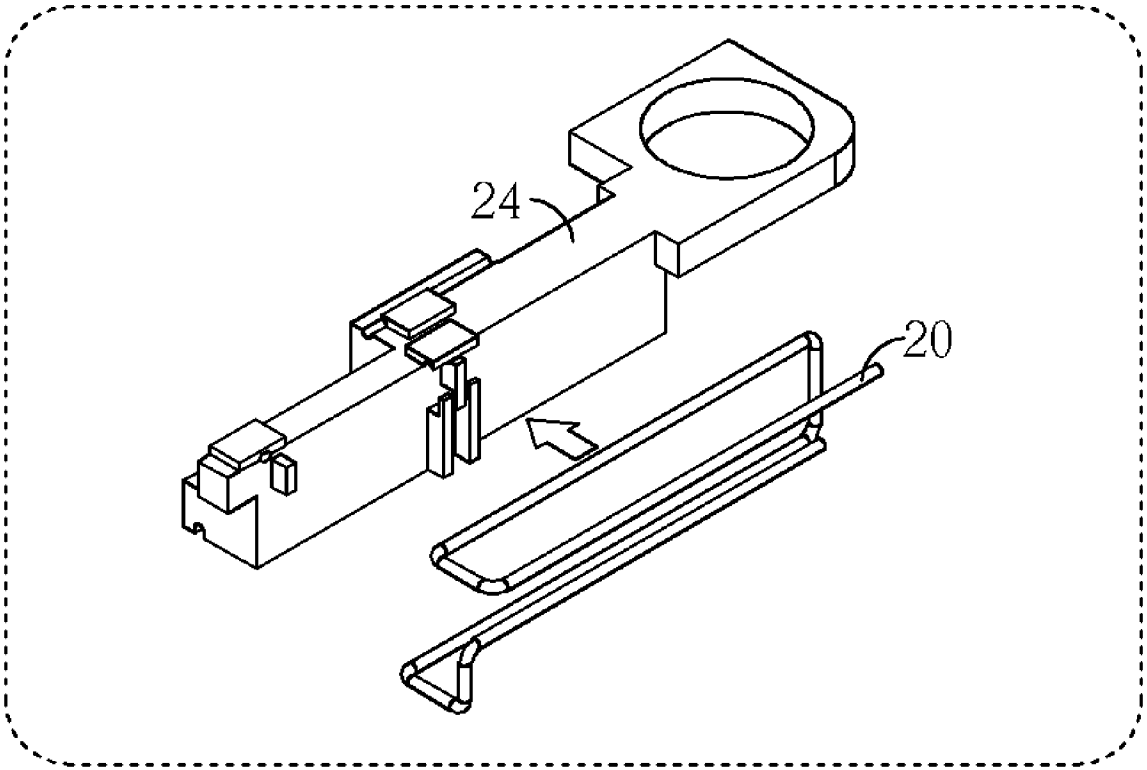
Figure 16:
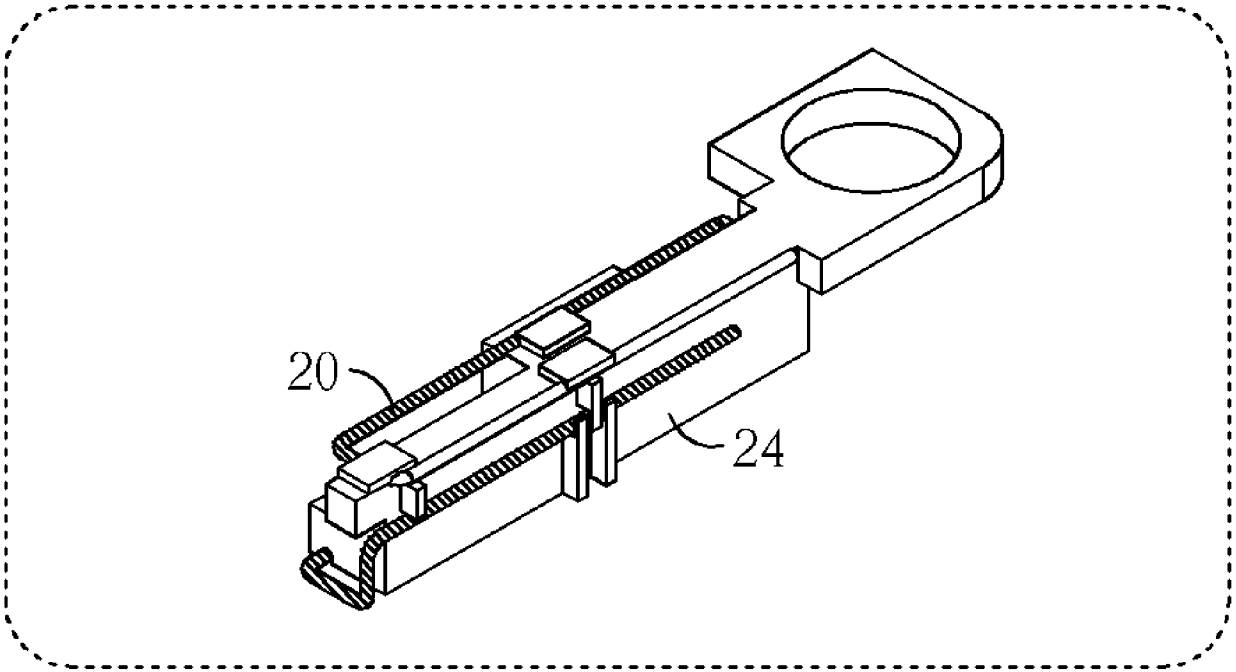

Please refer to FIG. 12. To continue the example explained by FIG. 2 to FIG. 9, FIG. 12 is a diagram of the antenna 20 installed on a circuit board 22 of the present invention. A signal feeding point of the antenna 20 is coupled to a corresponding circuit on the circuit board 22 (for instance, a printed circuit board) to receive feeding-ins and feeding-outs of signals. The antenna of the present invention can also be placed on fixtures in practice when installing the antenna on a communications device.

Please refer to FIGS. 13-16. FIGS. 13-16 are diagrams of different viewing points presenting an installation of the antenna 20 with a fixture 24. The fixture 24 can be a medium material (i.e. a non-conductive material such as plastic etc.).

As shown in FIGS. 13-16, the fixture 24 comprises various holes and rails to fit with the antenna structure of the present invention. When the fixture 24 and the antenna 20 are fixed together, it can be easily placed on a circuit board (not shown in FIGS. 13-16). For example, the fixture 24 can comprise tenons, screw holes etc. to have the antenna/fixture combination fixed on the circuit board. The fixture 24 not only fixes/protects the three-dimensional structure of the antenna 20, but also can be used as a supporting pole for other communications devices (such as camera lens etc.) The material of the fixture 24 can affect the characteristics of the antenna 20. However, as explained earlier, the distance d (FIG. 9) between the low/high frequency radiation portions can be adjusted to fine-tune the characteristics and compensate effects of the fixture 24. In reverse, the characteristics or other radiation characteristics (like radiation field) of the antenna can also be adjusted, varied through tuning or changing the medium material of the fixture 24.

Figure 17:
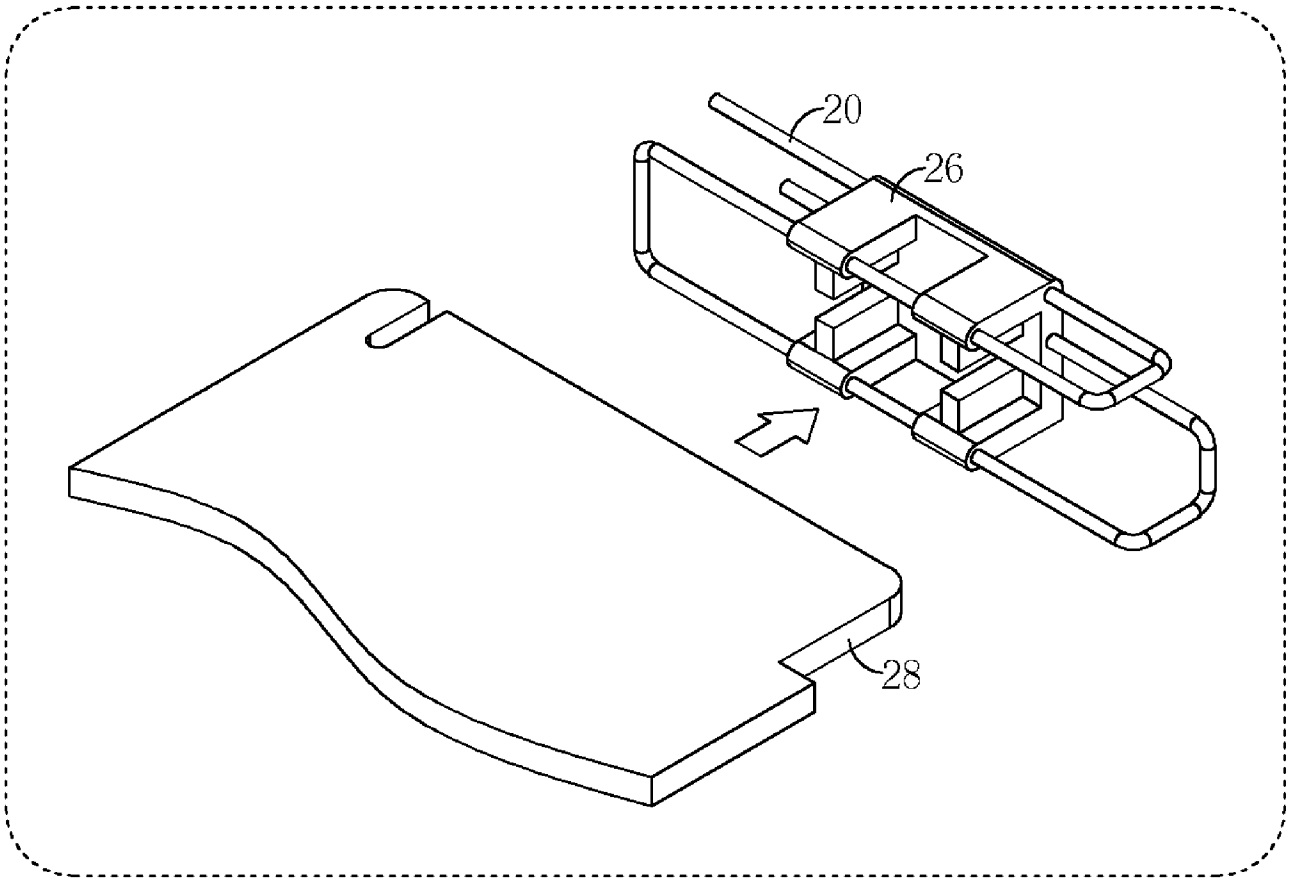
FIGS. 17-18 are diagrams of the antenna in FIG. 2 embedded in a circuit board.
Figure 18:
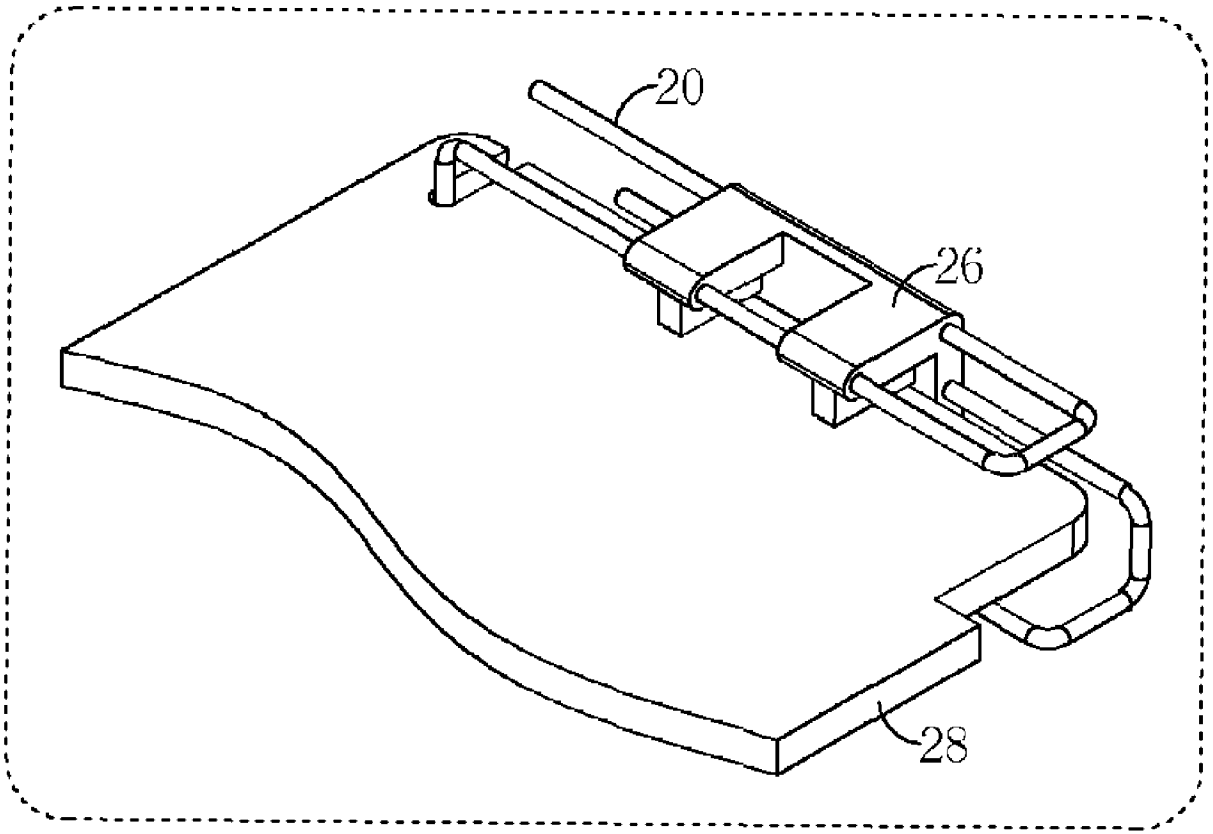

Other than fixing the antenna of the present invention on a surface of a circuit board as illustrated in FIG. 12, the antenna can also be fixed on a side of a circuit board to match with a fixture since the present invention has a three-dimensional structure, so that space occupied by the antenna is further reduced. Please refer to FIGS. 17-18, which illustrate the antenna 20 embedded on a circuit board 28 with a fixture 26. As shown in FIGS. 17-18, a structure of the fixture 26 corresponds to a thickness of the circuit board 28 to have the antenna 20 embedded in one side of the circuit board 28. Therefore, the antenna 20 with the three-dimensional structure is able to embed in and distribute in two different sides of a circuit board (meaning that different sections of the antenna 20 can be distributed on the two different sides of the circuit board 28) to reduce space taken by the antenna.

Figure 2:
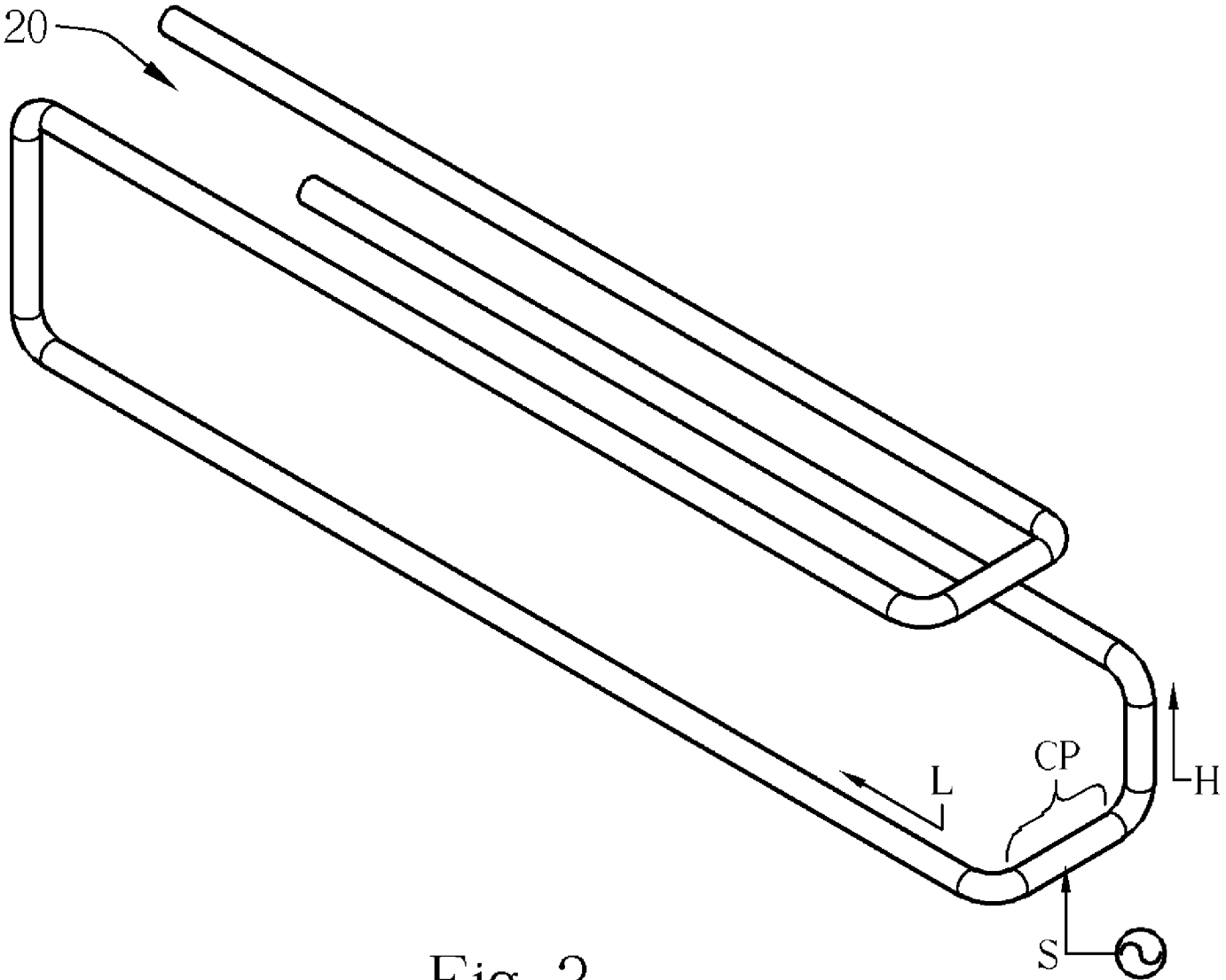
FIGS. 2-5 are diagrams of an embodiment of an antenna of the present invention from various perspectives.
Figure 3:
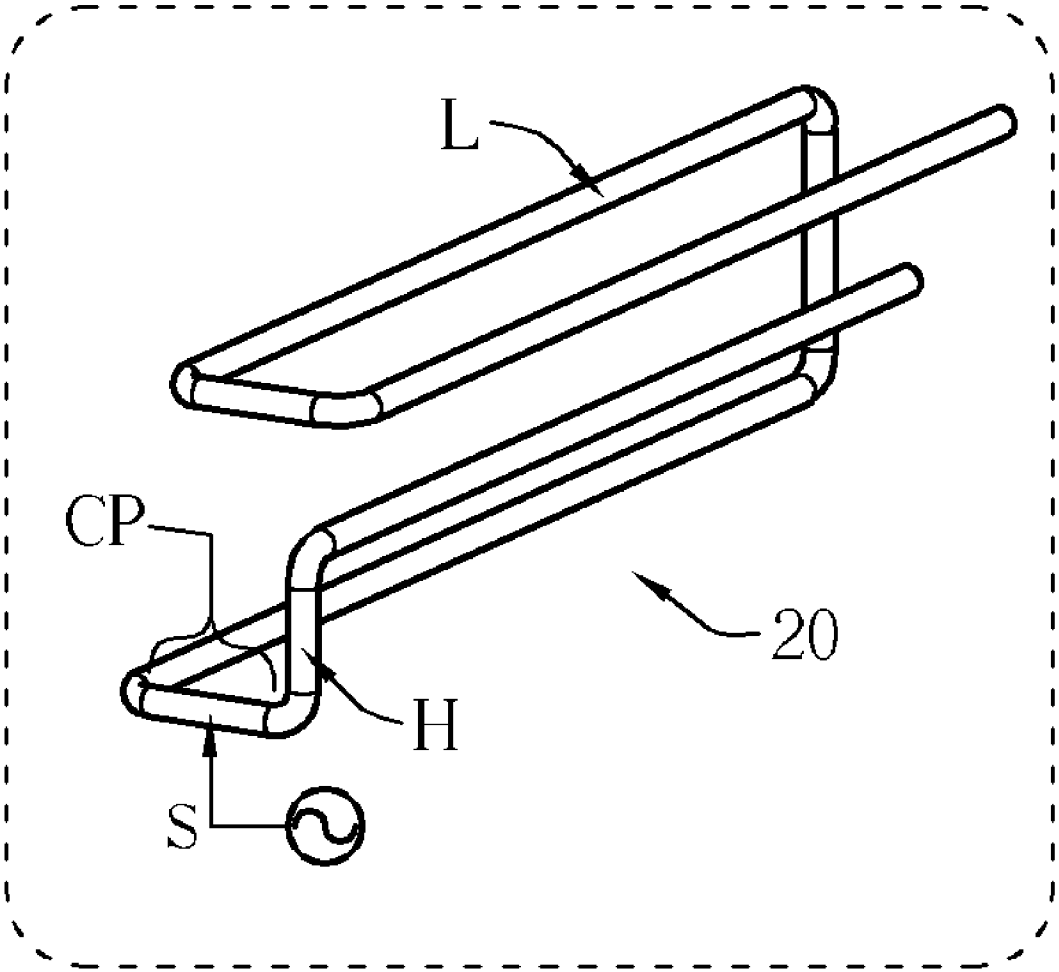
Figure 4:
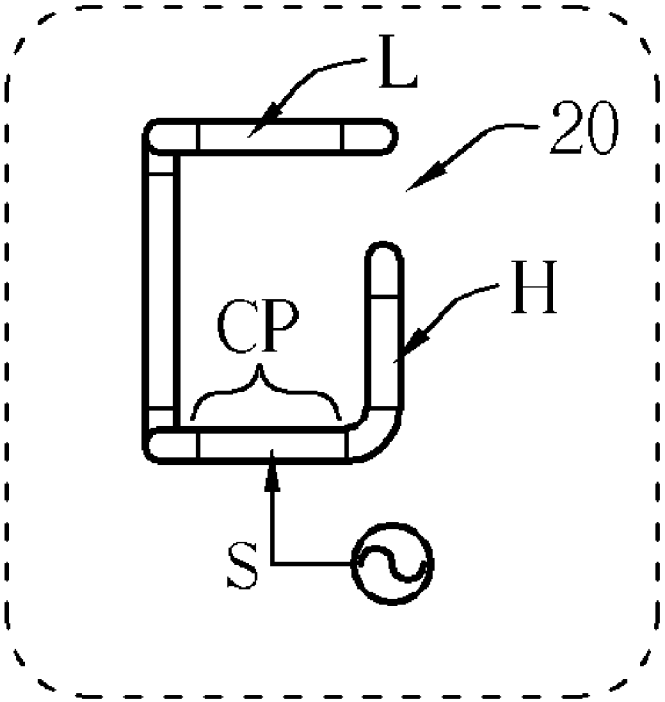
Figure 5:
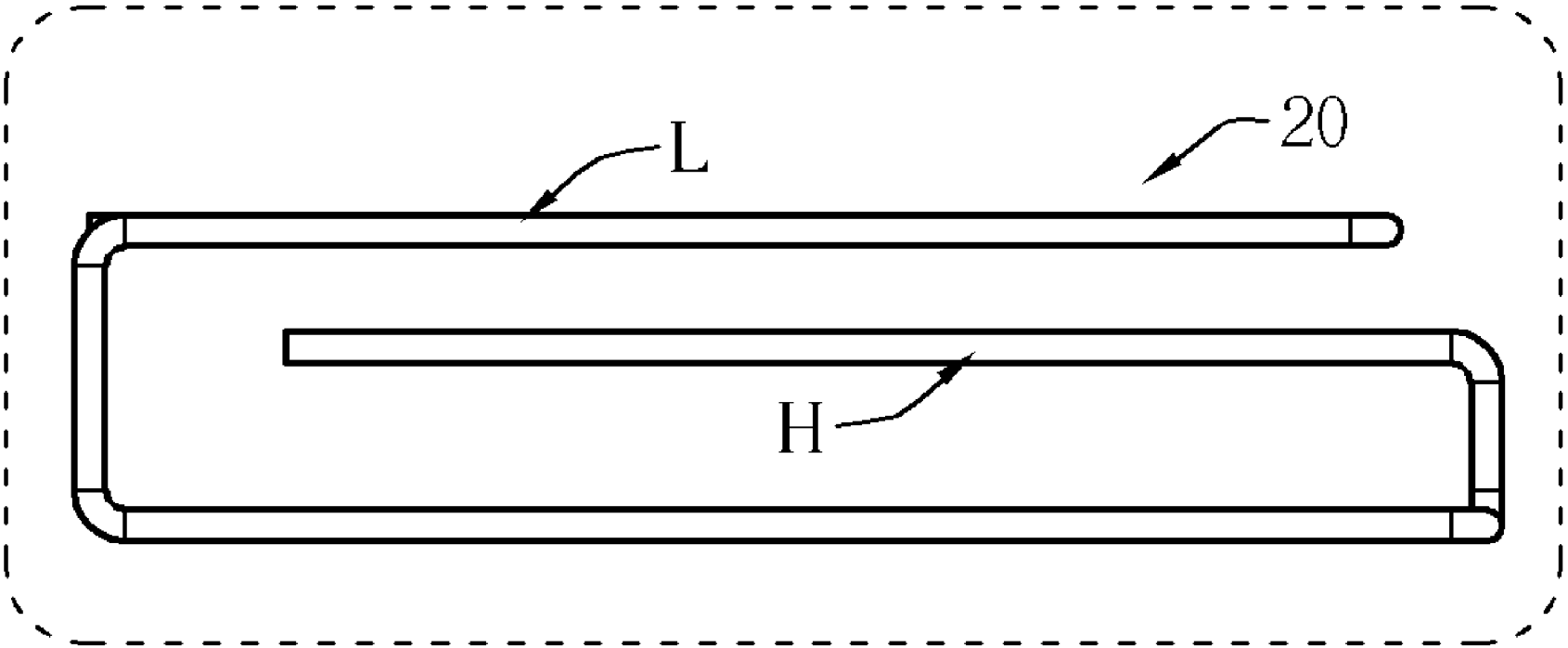
Figure 19:
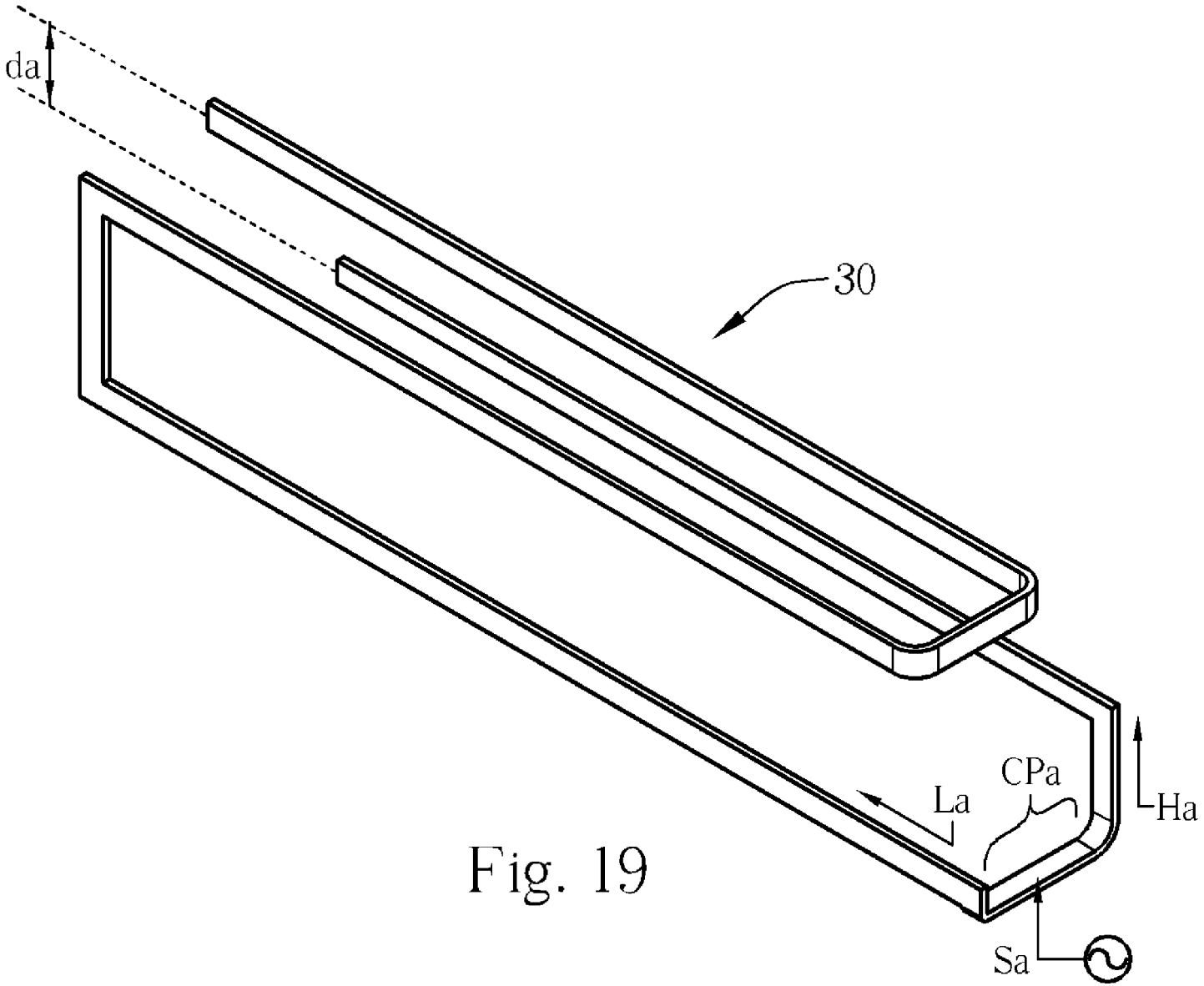
FIGS. 19-26 presents various embodiments of the antenna of the present invention respectively.

In the embodiment shown in FIG. 2 (to FIG. 9), the present invention is formed by constructing the conductor having a uniform cross section (circular cross section). With the structure of the present invention, other types of conductors can also be used to construct an antenna. Please refer to FIG. 19. FIG. 19 is another embodiment of an antenna 30 of the present invention. As illustrated in FIG. 19, the antenna 30 uses a bending stamp of a flat metal strip. Similar to the antenna 20 in FIG. 2, the antenna 30 in FIG. 19 also comprises a coupling portion CPa (with a signal feeding point Sa), a low frequency radiation portion La and a high frequency radiation portion Ha, to put the theory of a monopole multi-band antenna into practice. With the same idea, a distance da between the low frequency radiation portion La and the high frequency radiation portion Ha can also be adjusted to tune a radiation characteristic of the antenna 30.

Figure 20:
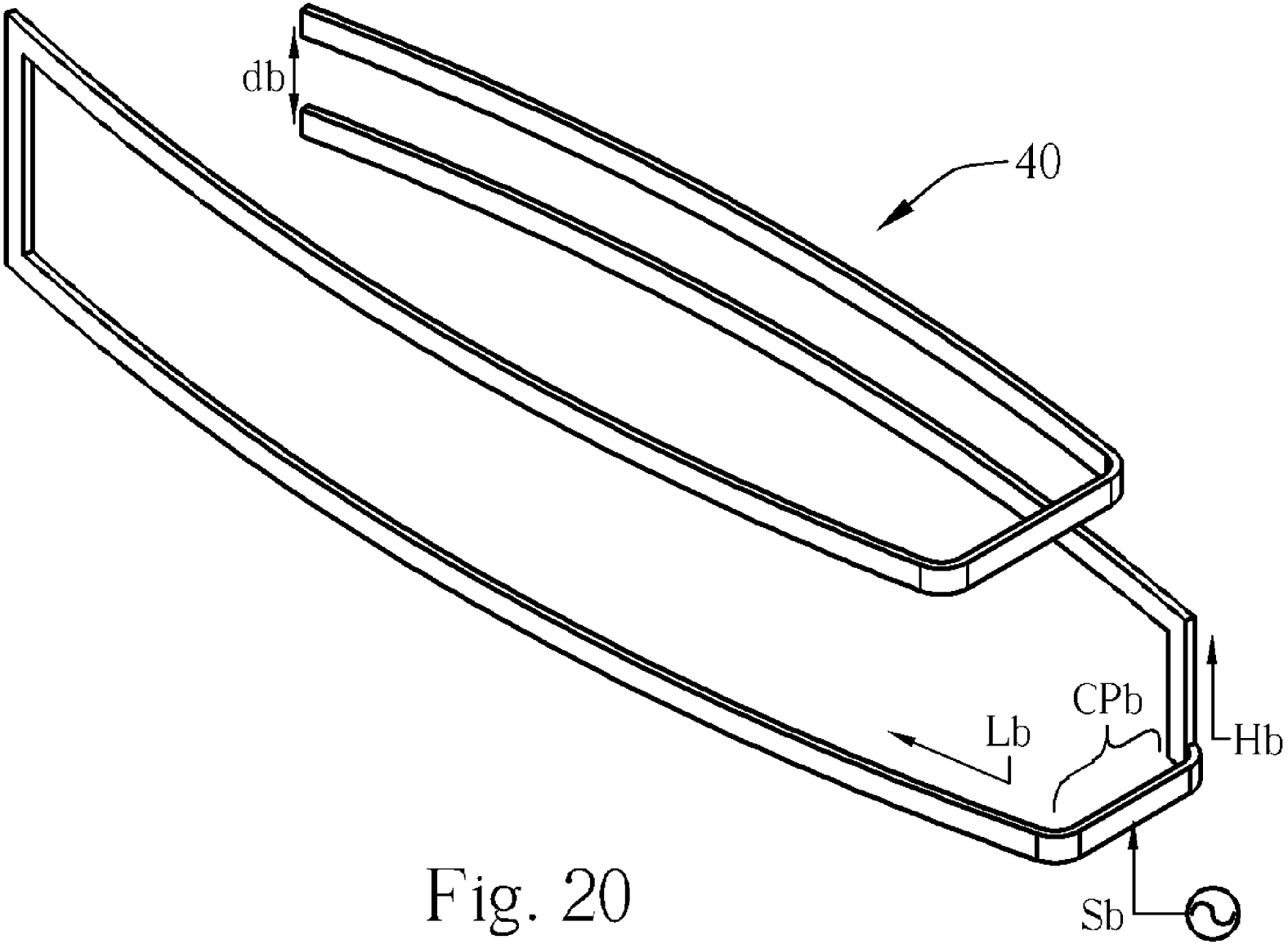
Figure 21:
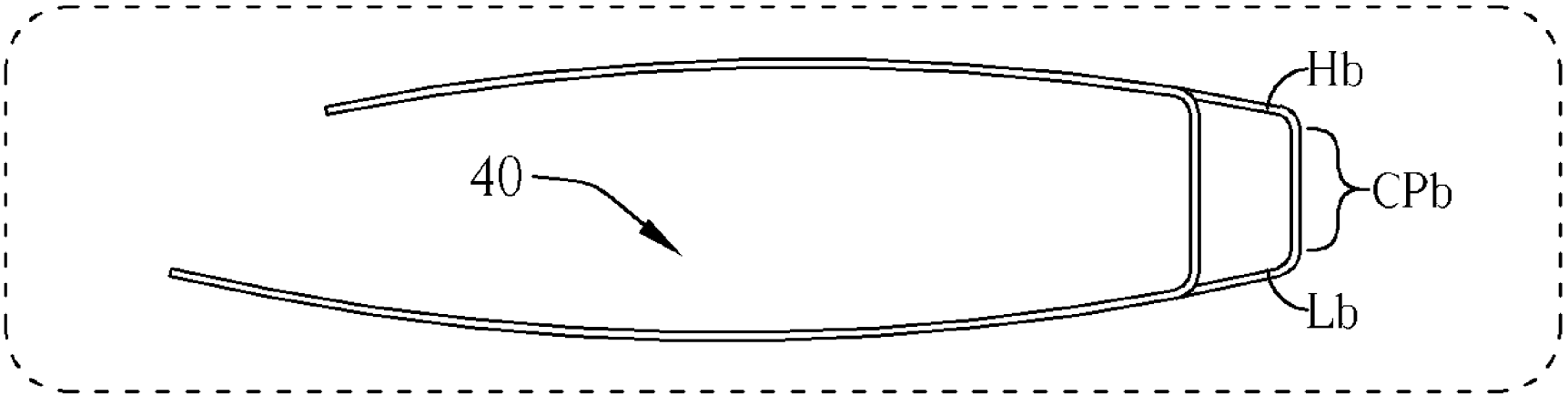

Please refer to FIGS. 20-21. FIGS. 20-21 are diagrams with different viewing points of another embodiment of an antenna 40 of the present invention. Similar to the antenna 30 in FIG. 19, the antenna 40 in FIGS. 20-21 is also formed with a bended flat metal strip, comprising a coupling portion CPb (with a signal feeding point Sb), a low frequency radiation portion Lb, and a high frequency radiation portion Hb. There is a difference that a main section (a longer section) of each section of the antenna 40 is curved. Even thus, terminal sections of the low frequency radiation portion Lb and the high frequency radiation portion Hb are still parallel to each other on a same curve plane and therefore increase intercoupling between the sections. The characteristics of the antenna 40 can be fine-tuned by changing the intercoupling through adjusting the distance db.

Figure 22:
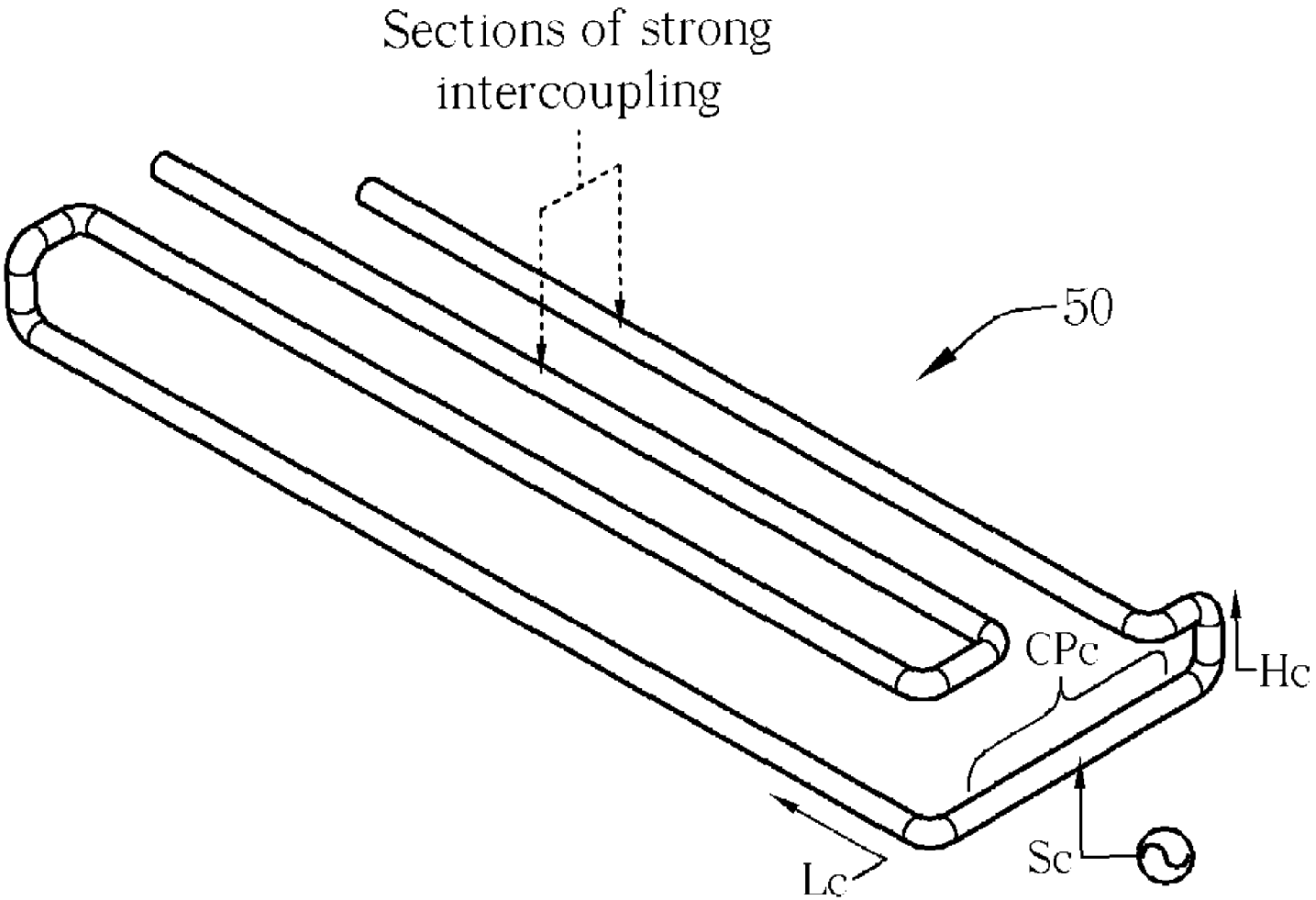
Figure 23:
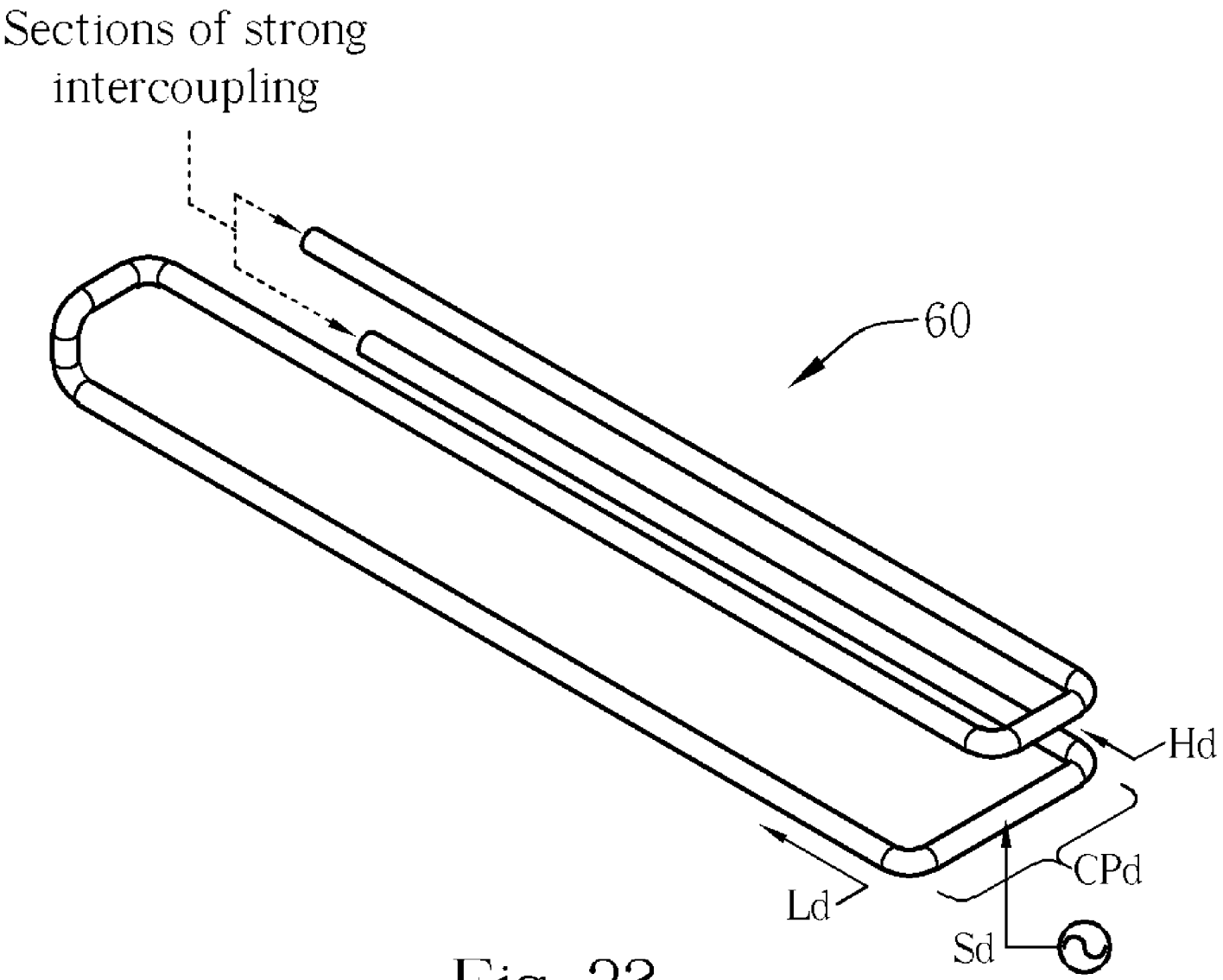

Please refer to FIG. 22 and FIG. 23. FIG. 22 and FIG. 23 present another two embodiments of antennas 50 and 60 of the present invention. In FIG. 22, the antenna 50 also comprises a coupling portion CPc (with a signal feeding point Sc), a low frequency radiation portion Lc, and a high frequency radiation portion Hc. The terminal sections of the low/high radiation portion are paralleled with a shorter distance between them to have a stronger intercoupling. In FIG. 23, the antenna 60 also comprises a coupling portion CPd (with a signal feeding point Sd), a low frequency radiation portion Ld, and a high frequency radiation portion Hd. The low frequency portion can only have one section, and the section is paralleled to a terminal section of the high frequency radiation portion to dominant an intercoupling between them.

Figure 24:
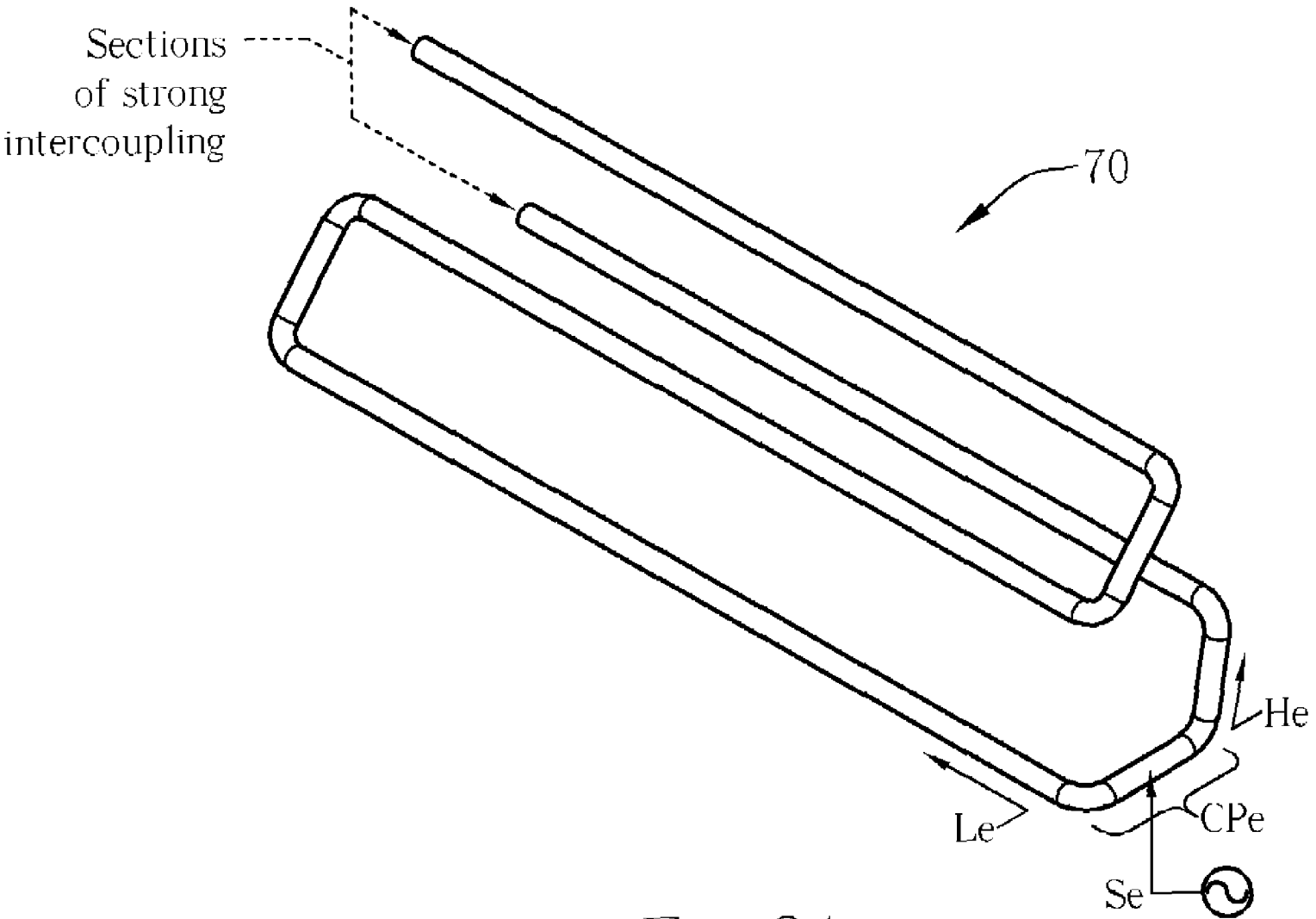
Figure 25:
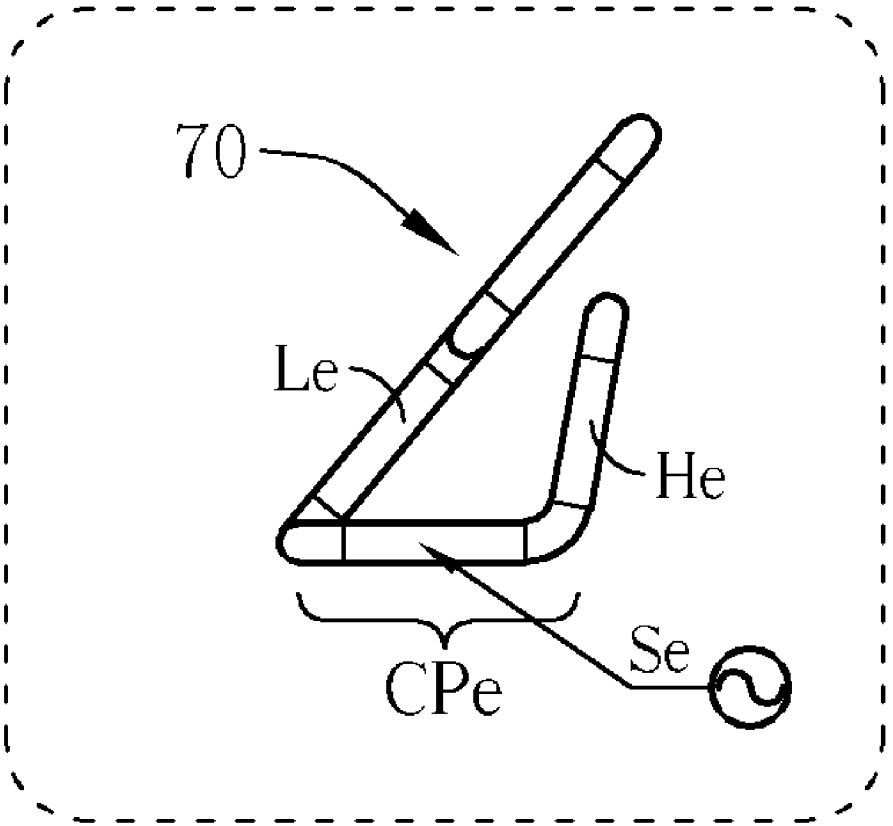
Figure 26:
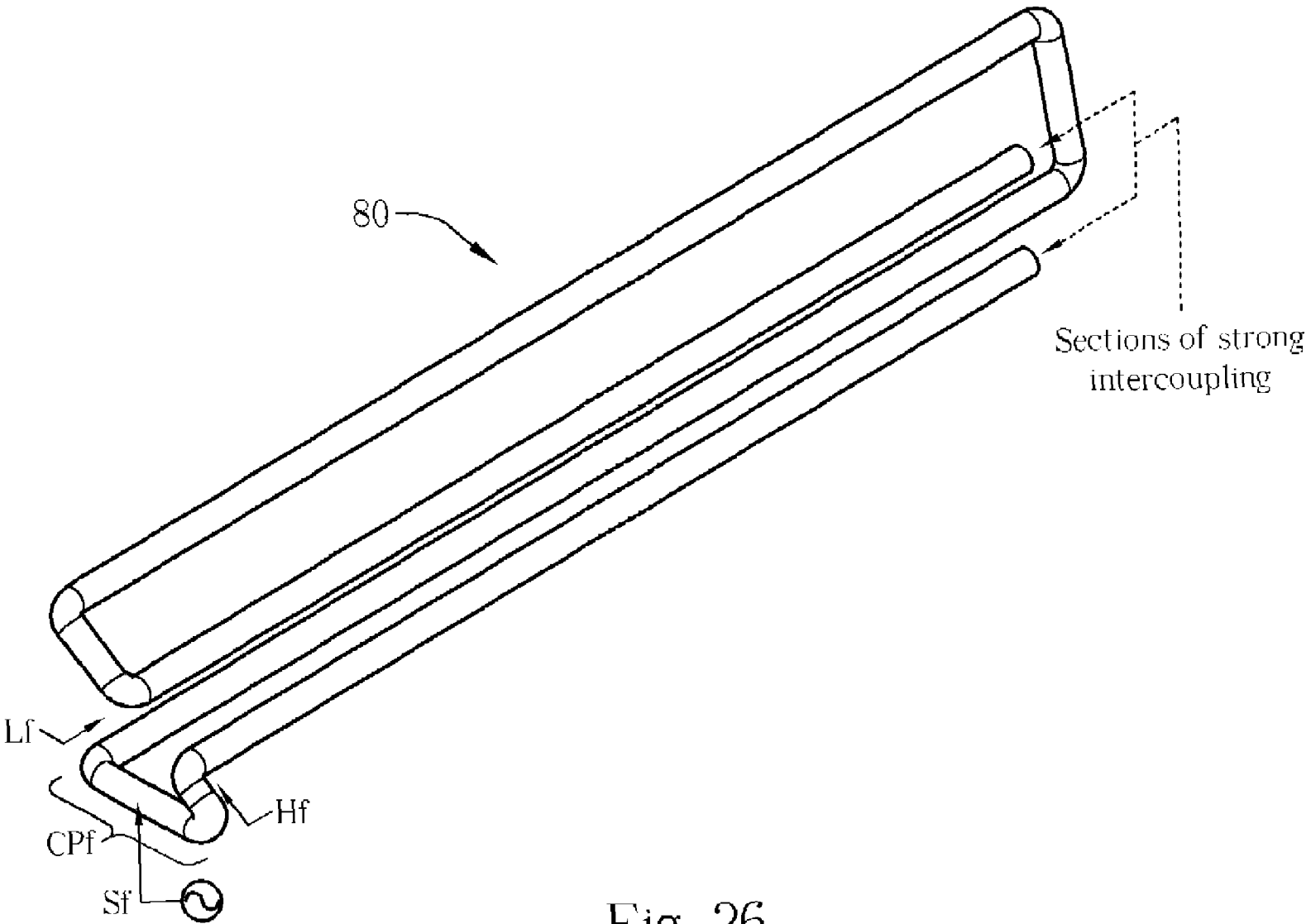

Please refer to FIGS. 24-25 and FIG. 26. FIGS. 24-26 present another two embodiments of antennas 70 and 80 of the present invention. FIGS. 24-25 illustrate the antenna 70 of the present invention from different views. The three-dimensional structure of the antenna in the present invention does not need to be distributed on planes that are perpendicular to each other. The antenna 70 shown in FIGS. 24-25 distributes each section on planes that are not perpendicular to each other. The antenna 70 also comprises a coupling portion CPe (with a signal feeding point Se), a low frequency radiation portion Le and a high frequency radiation portion He. The low frequency radiation portion Le bends into several sections along a plane, and terminal sections of the low/high frequency radiation portions are also close to and paralleled to each other to have a strong intercoupling. The antenna 80 also comprises a coupling portion CPf (with a signal feeding point Sf), a low frequency radiation portion Lf, and a high frequency radiation portion Hf, where terminal sections of the low/high frequency radiation portions are also close to and paralleled to each other to have a strong intercoupling.

As the embodiments show in FIG. 19 to FIG. 26, the present invention can be formed with a conductor (for instance, the coupling portion and the low/high frequency radiation portions are formed with one bended metal having a uniform cross section), which saves time and money consumed in manufacturing. However, the antenna in the present invention can also be formed with different conductors, for example, different metal conductors with different cross sections forming low/high frequency radiation portions respectively, and combined to be an antenna with a conductor being a coupling portion.

In conclusion, compared with the prior art, the monopole antenna of the present invention bends to form a three-dimensional structure comprising low/high frequency radiation portions effectively reducing space occupied by the antenna. A controllable intercoupling between the low/high frequency radiation portions is established, with the intercoupling the overall characteristics and performance of the antenna are improved (for instance, increases the usable bandwidth of the antenna in high frequency bands). Therefore, the present invention, with a compact antenna, supports various low/high frequency bands to cater different needs from wireless communication networks.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-band antenna comprising:

a coupling portion for feeding-in or feeding-out signals;

a first radiation portion coupled to one end of the coupling portion; the first radiation portion bended at one or more bending points to form a plurality of sections, and at least two sections distributed on two planes that are not parallel to each other; and a second radiation portion coupled to another end of the coupling portion; the second radiation portion comprising at least one section, wherein a section of the at least one section of the second radiation portion is parallel to a terminal section of the first radiation portion, has a similar length as the terminal section of the first radiation portion, and is substantially aligned with the terminal section of the first radiation portion in order to have radiation characteristics of the two parallel paralleled sections intercoupled for increasing a bandwidth of the multi-band antenna, wherein the terminal section being a section of the first radiation portion extended furthest from the coupling portion.

2. The multi-band antenna of claim 1 wherein a distance between the section of the second radiation portion and the terminal section of the first radiation portion is smaller than a distance between the section of the second radiation portion and any other section of the first radiation portion.

3. The multi-band antenna of claim 1 wherein the second radiation portion is bended at one or more bending points to form a plurality of sections.

4. The multi-band antenna of claim 1 wherein the section of the second radiation portion is on a same plane as the terminal section of the first radiation portion.

5. The multi-band antenna of claim 1 is a monopole antenna.

6. The multi-band antenna of claim 1 wherein the first radiation portion is used for radiating electromagnetic waves in low frequency bands, the second radiation portion is used for radiating electromagnetic waves in high frequency bands, so the multi-band antenna supports transmitting and receiving of multi-band wireless signals.

7. The multi-band antenna of claim 1 wherein the first radiation portion and the second radiation portion are formed with bended conductors having uniform cross sections.

8. The multi-band antenna of claim 1 further comprising a fixture which comprises a medium material for protecting a structure of the multi-band antenna or adjusting characteristics of the multi-band antenna.

9. The multi-band antenna of claim 8, wherein the fixture allows the antenna to be embedded on a circuit board so that different sections of the multi-band antenna are distributed on both sides of the circuit board.

10. A multi-band antenna comprising:

a coupling portion used for receiving a feed-in or a feed-out of a signal;

a first radiation portion coupled to one end of the coupling portion; the first radiation portion bended at one or more bending points to form a plurality of sections; and a second radiation portion coupled to another end of the coupling portion; the second radiation portion comprising at least one a section, wherein a section of the at least one section of the second radiation portion is parallel to a terminal section of the first radiation portion, has a similar length as the terminal section of the first radiation portion, and is substantially aligned with the terminal section of the first radiation portion in order to have radiation characteristics of the two parallel paralleled sections intercoupled for increasing a bandwidth of the multi-band antenna, wherein the terminal section being a section of the first radiation portion extended furthest from the coupling portion.

11. The multi-band antenna of claim 10 wherein a distance between the section of the second radiation portion and the terminal section of the first radiation portion is smaller than a distance between the section of the second radiation portion and any other section of the first radiation portion.

12. The multi-band antenna of claim 10 wherein a terminal section of the second radiation portion is a section of the second radiation portion extended furthest from the coupling portion.

13. The multi-band antenna of claim 10, wherein the first radiation portion is used for radiating electromagnetic waves in low frequency bands, the second radiation portion is used for radiating electromagnetic waves in high frequency bands, so the multi-band antenna supports transmitting and receiving of multi-band wireless signals.

14. The multi-band antenna of claim 10 further comprising a fixture that comprises a medium material used for protecting a structure of the multi-band antenna or adjusting characteristics of the multi-band antenna.

15. The multi-band antenna of claim 14 wherein the fixture allows the antenna to be embedded on a circuit board so that different sections of the multi-band antenna are distributed on both sides of the circuit board.

16. The multi-band antenna of claim 10 wherein the plurality of sections of the first radiation portion have similar lengths and are in parallel with each other, and each of the plurality of sections of the first radiation portion has a majority segment aligned with a corresponding majority segment of the section of the second radiation portion.

17. A multi-band antenna comprising:

a coupling portion, used for receiving a feed-in or a feed-out of a signal;

a first radiation portion coupled to one end of the coupling portion formed with bended conductors having uniform cross sections; the first radiation portion bended at one or more bending points to form a plurality of sections; and a second radiation portion coupled to another end of the coupling portion and formed with bended conductors having uniform cross sections; the second radiation portion comprising at least one section, a section of the at least one section of the second radiation portion is parallel to a terminal section of the first radiation portion, has a similar length as the terminal section of the first radiation portion, and is substantially aligned with the terminal section of the first radiation portion in order to have radiation characteristics of the two parallel sections intercoupled for increasing a bandwidth of the multi-band antenna, wherein the terminal section being a section of the first radiation portion extended furthest from the coupling portion.

* * * * *